US012708164B2

(12) United States Patent
Bennett

(10) Patent No.: US 12,708,164 B2
(45) Date of Patent: Aug. 18, 2026

(54) SYSTEMS TO IMPROVE WEARABILITY AND COMFORT OF HEADWEAR AND RELATED METHODS

(71) Applicant: Jostens, Inc., Minneapolis, MN (US)

(72) Inventor: Danielle Marie Bennett, Chanhassen, MN (US)

(73) Assignee: Jostens, Inc., Minneapolis, MN (US)

( * ) Notice: Subject to any disclaimer, the term of this patent is extended or adjusted under 35 U.S.C. 154(b) by 0 days.

(21) Appl. No.: 18/732,045

(22) Filed: Jun. 3, 2024

(65) Prior Publication Data

US 2025/0366555 A1 Dec. 4, 2025

(51) Int. Cl.

| | |
|---|---|
| ***A42B 1/22*** | (2006.01) |
| ***A41G 5/00*** | (2006.01) |
| ***A42B 1/205*** | (2021.01) |
| ***A42B 7/00*** | (2006.01) |
| ***A45D 8/36*** | (2006.01) |

(52) U.S. Cl.

CPC ..... *A42B 1/22* (2013.01); *A41G 5/0093* (2013.01); *A42B 1/205* (2013.01); *A42B 7/00* (2013.01); *A45D 8/36* (2013.01)

(58) Field of Classification Search

CPC ..... A42B 1/002; A42B 1/201; A42B 1/02; A42B 1/24; A42B 1/004; A42B 1/205; A42B 1/22; A42B 7/00; A42B 3/32; A41G 5/009; A45D 8/006; A45D 8/36; A45D 8/004; A41D 27/08; A41D 20/00; A42C 3/04; Y10S 2/11

USPC ..... 132/275

See application file for complete search history.

(56) References Cited

U.S. PATENT DOCUMENTS

| | | | | | |
|---|---|---|---|---|---|
| 213,415 | A * | 3/1879 | Halvorson | A42B 1/201 | 2/171.03 |
| 215,998 | A * | 5/1879 | Waddell et al. | A42B 1/22 | 2/181.2 |
| 218,498 | A * | 8/1879 | Davis | A42B 1/0184 | 2/171.04 |
| 229,464 | A * | 6/1880 | Ray | A42B 1/201 | 2/195.6 |
| 244,315 | A * | 7/1881 | Ross | A42B 1/201 | 2/171.03 |
| 248,542 | A * | 10/1881 | Wilson | A45D 8/12 | 132/275 |
| 275,670 | A * | 4/1883 | Kendall | A42B 7/00 | 2/181.6 |

(Continued)

*Primary Examiner* — Heather Mangine
*Assistant Examiner* — Raquel M. Weis
(74) *Attorney, Agent, or Firm* — Brown Rudnick LLP; Matthew P. York

(57) ABSTRACT

A headwear securing system can comprise an outer ring, an inner ring, a headband, and one or more tabs. The inner ring can be configured to be received in a volume circumscribed by the outer ring such that an outer surface of the inner ring faces an inner surface of the outer ring, and can comprise one or more receptacles, each defining a receiving space. Each of the tab(s) can be coupled to and extend away from an upper surface of the headband and can be configured to be received in the receiving space defined by a respective one of the receptacle(s) such that the tab releasably engages the receptacle. When the tab(s) are so-received, a portion of the headband can be disposed in and the first and second ends of the headband can be disposed below the volume circumscribed by the outer ring.

20 Claims, 33 Drawing Sheets

(56) References Cited

U.S. PATENT DOCUMENTS 422,137 A * 2/1890 Massey ..... A42B 7/00 2/175.7
543,170 A * 7/1895 Carpenter ..... A42B 7/00 132/62
671,887 A * 4/1901 Huppertz ..... A42B 7/00 132/59
678,725 A * 7/1901 Gauen ..... A42B 7/00 132/59
753,314 A * 3/1904 Rickard ..... A42B 7/00 132/57.1
836,899 A * 11/1906 Smith ..... A42B 1/02 2/171.01
1,058,323 A * 4/1913 Mueller ..... A42B 7/00 132/57.1
1,234,828 A * 7/1917 Tramana ..... A42B 1/02 2/175.4
1,283,686 A * 11/1918 Dahl ..... A42B 7/00 132/59
1,539,706 A * 5/1925 Wallman ..... A45D 8/36 132/273
1,584,329 A * 5/1926 Skaruda ..... A45D 8/36 132/130
1,665,750 A * 4/1928 Mckee ..... A61F 9/045 2/171.7
1,692,719 A * 11/1928 Busey ..... A42B 7/00 132/273
1,745,184 A * 1/1930 Myers ..... A42B 1/02 2/171.01
1,934,114 A * 11/1933 Brander ..... A42B 1/02 2/171.01
2,116,076 A * 5/1938 Lipton ..... A42B 1/22 2/171.7
2,153,146 A * 4/1939 Holmes ..... A42B 1/02 2/171.01
2,181,446 A * 11/1939 Ames ..... A42B 1/0184 2/171.4
2,227,554 A * 1/1941 Riordon ..... A42B 1/201 2/171.03
2,248,497 A * 7/1941 Gelvin ..... A42B 1/02 2/200.3
2,289,370 A * 7/1942 Krag ..... A42B 1/02 2/171.01
2,418,069 A * 3/1947 Delano ..... A42B 1/201 2/200.1
2,428,937 A * 10/1947 Lazarus ..... A42B 1/201 2/171.7
2,490,508 A * 12/1949 Delgatto ..... A42B 1/002 223/84
2,629,873 A * 2/1953 Jarosenski ..... A42B 1/22 2/181.2
2,629,874 A * 2/1953 La Maida ..... A42B 1/02 2/209.3
2,684,483 A * 7/1954 Kwake ..... A42B 1/201 2/172
3,134,107 A * 5/1964 Ellis ..... A42B 1/02 2/200.3
3,945,050 A * 3/1976 Bohash ..... A42C 5/04 2/195.1
4,062,067 A * 12/1977 Franzen ..... A42B 1/22 2/909
4,447,250 A * 5/1984 Wolens ..... A63H 37/00 2/209.13
4,999,846 A * 3/1991 Ball ..... A42B 1/22 2/418
5,027,992 A * 7/1991 Murray, III ..... G09F 21/02 D2/869
5,386,592 A * 2/1995 Checkeroski ..... A42B 1/244 2/209.13
5,604,935 A * 2/1997 Nezer ..... A42B 3/322 2/424
5,826,597 A * 10/1998 Chou ..... A45D 8/36 132/273
6,049,912 A * 4/2000 Linehan ..... G09F 21/02 2/244
6,237,611 B1 * 5/2001 LeCrone ..... A42B 1/24 132/275
6,263,515 B1 * 7/2001 Turner ..... A42B 3/00 2/410
6,357,052 B1 * 3/2002 Fleming ..... A42B 1/004 2/244
6,382,218 B1 * 5/2002 Cheng ..... A42B 1/16 63/3
6,513,167 B1 * 2/2003 Cheng ..... A45D 8/36 2/209.13
9,936,753 B2 * 4/2018 Yeh ..... A41G 7/00
D820,519 S * 6/2018 Templer ..... D2/866
10,182,605 B1 * 1/2019 Cleveland ..... A42C 5/02
D852,464 S * 7/2019 Kirschner ..... D2/882
D855,292 S * 8/2019 Robinson ..... D2/866
2003/0121127 A1 * 7/2003 Walker ..... A41D 20/00 24/306
2003/0221242 A1 * 12/2003 Yeh ..... A42B 7/00 132/273
2005/0056298 A1 * 3/2005 McRoberts ..... A45D 8/34 132/276
2007/0199132 A1 * 8/2007 Lehmann ..... A42C 5/02 2/181
2012/0118317 A1 * 5/2012 Payne ..... A45D 8/006 132/275
2014/0130819 A1 * 5/2014 Karam ..... A41G 5/0093 132/54
2016/0003467 A1 * 1/2016 Wang ..... A45D 8/36 132/275
2016/0044981 A1 * 2/2016 Frank ..... G02B 27/0176 2/422
2016/0073757 A1 * 3/2016 Beckerman ..... A45D 8/36 132/200
2017/0099928 A1 * 4/2017 Krebsbach ..... A43B 23/24
2019/0166944 A1 * 6/2019 Mini Townson ..... A42B 3/127
2020/0229525 A1 * 7/2020 Tsai ..... A42B 1/006
2022/0295936 A1 * 9/2022 Wright ..... A42B 7/00
2025/0089833 A1 * 3/2025 Fumey ..... A42B 1/22
2025/0089839 A1 * 3/2025 Fumey ..... A42B 1/02

* cited by examiner

SYSTEMS TO IMPROVE WEARABILITY AND COMFORT OF HEADWEAR AND RELATED METHODS

BACKGROUND

A. Field of the Invention

The present invention relates generally to devices intended to improve the fit and increase the comfort of headwear.

B. Description of Related Art

Some headwear such as an academic cap relies on a "one-size-fits-all" or "one-size-fits-most" approach to accommodate wearers having different head sizes. Academic caps, for example, typically have a skullcap with an elastic edge that can be stretched to fit over a wearer's head. However, the inventor has recognized challenges stemming from these one-size approaches to fitting headwear, which can make wearing headwear such as an academic cap a frustrating experience for a wearer. For example, these approaches typically offer limited size adjustability, which can often cause the caps to fit poorly (or not at all). The poor fit can not only cause the headwear to look bad on the wearer, but can additionally cause discomfort (especially when worn over extended periods of time). These challenges are especially salient for wearers with a significant amount of hair, which can further impair the fit of headwear that is not adequately designed to accommodate such hair.

SUMMARY OF THE INVENTION

Thus, there is a need in the art for systems and methods to allow headwear to better fit wearers having different head sizes and to provide a more comfortable wearing experience. Various embodiments of the present headwear securing systems and methods of using the same can address this need by providing a mechanism that 1) can be secured to a portion of the headwear and 2) can better fit on the wearer's head than the headwear itself. Thus, the system can act as a better-fitting interface between the headwear and the wearer's head, providing a neater aesthetic when wearing the headwear while simultaneously improving comfort.

To provide such an interface, the headwear securing system can comprise an outer ring, an inner ring, a headband, and one or more tabs coupled to the headband. The inner and outer rings can act as an interface between the headwear securing system and the headwear, which can be, for example, an academic cap. To do so, the outer ring can be shaped and sized to fit within a portion of the headwear that is configured to fit around the head of a wearer and the inner ring can be configured to be received in a volume circumscribed by the outer ring such that a portion of the headwear can be secured between the outer and inner rings. For example, when interfacing with an academic cap that comprises a board and a skullcap that is coupled to and underlies the board, the outer ring can be placed within the skullcap and on the inner surface of the board of the academic cap. The skullcap can then be folded over the outer ring such that the skullcap covers the outer ring's inner and outer surfaces and the skullcap's edge is disposed in the volume circumscribed by the outer ring. Then, the inner ring can be slid into place inside of the volume of the outer ring such that the skullcap can be secured between the inner and outer rings. With the inner ring so-disposed, both rings can be secured in relation to each other, and the academic cap can be secured in relation to the rings due to the skullcap material being sandwiched between the two rings.

The inner ring and outer ring can be of similar shape and size, with the inner ring being slightly smaller than the outer ring and sized such that along at least a majority of the inner ring's outer surface there can be a small gap (e.g., less than or equal to 3 millimeters) between the inner ring's outer surface and the outer ring's inner surface when the inner ring is disposed in the volume circumscribed by the outer ring. This gap can provide a space for headwear material—such as a portion of the skullcap of the academic cap—to be secured between the inner and outer rings. The smallness of the gap can facilitate the securement of a portion of the headwear (e.g., the skullcap of the academic cap) between the inner and outer rings by promoting friction therebetween, as when the portion of the headwear is folded over the outer ring and the inner ring is pressed into place within the volume circumscribed by the outer ring, the portion of the headwear can be pressed between the inner and outer rings such that friction between the inner ring, outer ring, and portion of the headwear disposed therebetween can held hold the components in place.

When the inner and outer rings secure a portion of the headwear like the skullcap of an academic cap, the outer ring can promote the aesthetics of the secured portion. For example, for an academic cap the portion of the skullcap disposed along the outer surface of the outer ring can be held taut such that it has a neat appearance. Additionally, the outer ring can have an elliptical cross-section that can be well-proportioned for a wearer's head.

The headband and tab(s) of the headwear securing system can be the interface between the wearer's head and the rest of the system. The headband can be configured to 1) fit comfortably and securely around a wearer's head, and 2) interface securely with the inner ring (and thus the remainder of the headwear securing system) via the tab(s) that can be coupled to the headband. To facilitate a comfortable and secure adornment on the wearer's head, the headband can be curved, optionally such that the angle that each of the front and rear edges of the headband subtend between its ends is greater than or equal to 180°. Additionally, the headband can comprise multiple protuberances along the lower surface of the headband that can be designed to interface with a wearer's hair to help secure the headband to their head.

Each of the tab(s) can be configured to be received in a receiving space of a respective one of one or more receptacles of the inner ring such that the tab releasably engages the receptacle, allowing the headband to be secured to the inner ring and thereby the remainder of the headwear securing system. For example, each of the tab(s) can extend away from the upper surface of the headband and can comprise a protrusion that can engage a ledge of the receptacle that has an upper surface that is substantially perpendicular to the inner surface of the inner ring to help secure the tab to the receptacle. The protrusion's upper surface (the part of the protrusion that can first contact the receptacle during insertion) can angled, thereby facilitating the protrusion's passage around the ledge as pressure exerted thereon elastically deflects the tab around the ledge when being pressed into place. Once the tab is fully inserted in the receptacle, the lower surface of the protrusion can be disposed on the upper surface of the ledge, allowing the tab to return to its original orientation such that the lower surface of the protrusion can engage the upper surface of the ledge to secure the tab within the receptacle. This design can allow the wearer to simply press the headband to cause the tab(s)

to be pressed into place within the receptacle(s) of the inner ring to effectively secure the components together. Should the wearer wish to disassemble these components, simply pressing laterally on the tab(s) can elastically deflect each one, at which point the user can pull the tab(s) out of the receptacle(s) to decouple the headband from the inner ring.

In other aspects, the invention comprises an ornamental design for one or more of the headwear securing system coupled to the academic cap, the headwear securing system, the inner ring and headband coupled together, and/or the headband, as depicted in certain of the figures and described in portions of the associated description.

In this manner, the installation of the headwear securing system can be a simple and easy process, and additionally, one that does not permanently alter the piece of headwear apparel. With the wearer comfortably adorning the headband on their head and the headband coupled to the inner and outer rings to which the headwear is secured, the headwear securing system can promote a neat, comfortable fit on a wearer's head, mitigating the issues associated with conventional one-size-fits-all or one-size-fits-most designs.

The term "coupled" is defined as connected, although not necessarily directly, and not necessarily mechanically. Two items that are "coupled" may be unitary with each other or may be connected to one another via one or more intermediate components or elements.

The terms "a" and "an" are defined as one or more unless this disclosure explicitly requires otherwise.

The term "substantially" is defined as largely, but not necessarily wholly, what is specified (and includes what is specified; e.g., substantially 90 degrees includes 90 degrees, and substantially parallel includes parallel), as understood by a person of ordinary skill in the art. As used herein, "substantially parallel" means within 10 degrees of parallel to, and "substantially perpendicular" means within 10 degrees of perpendicular to. In any disclosed embodiment, the term "about" can be substituted with "within [a percentage] of" what is specified, where the percentage includes 0.1, 1, 5, and 10 percent.

The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those one or more elements. Likewise, a method that "comprises," "has," "includes," or "contains" one or more steps possesses those one or more steps, but is not limited to possessing only those one or more steps.

Any embodiment of any of the systems and methods can consist of or consist essentially of—rather than comprise/have/include/contain—any of the described elements, features, and/or steps. Thus, in any of the claims, the phrase "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate identical structures. Rather, the same reference numbers may be used to indicate similar features or features with similar functionalities, as may non-identical reference numbers. The figures are drawn to scale unless otherwise noted, meaning the sizes of the depicted elements in each are accurate relative to each other for at least the embodiment shown.

FIG. 1A depicts the system before the outer ring, inner ring, and headband are coupled together.

DETAILED DESCRIPTION

Figure 1A:
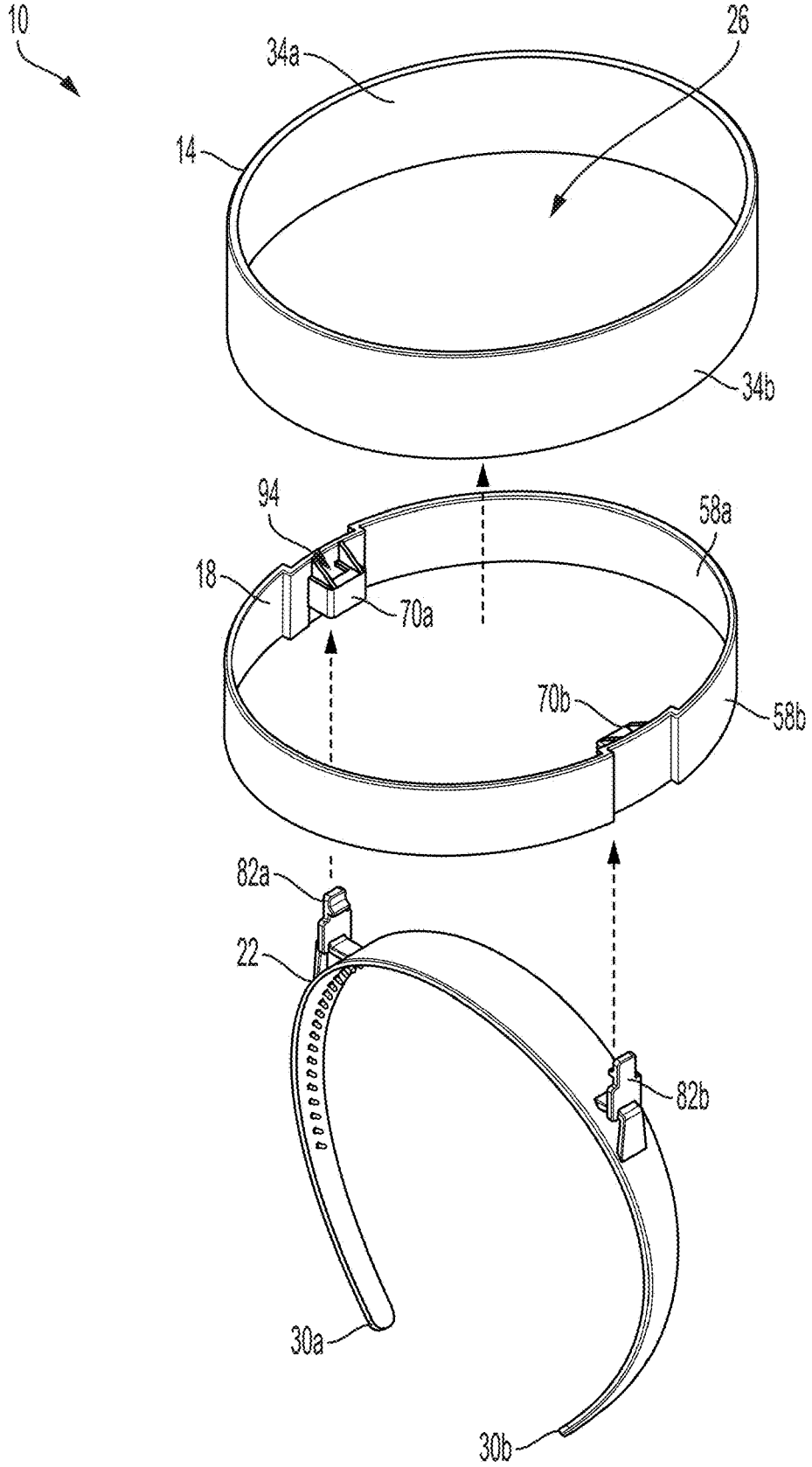
FIG. 1A depicts a perspective view of a first embodiment of the present headwear securing systems that comprises an outer ring, an inner ring, a headband, and one or more tabs.
Figure 1B:
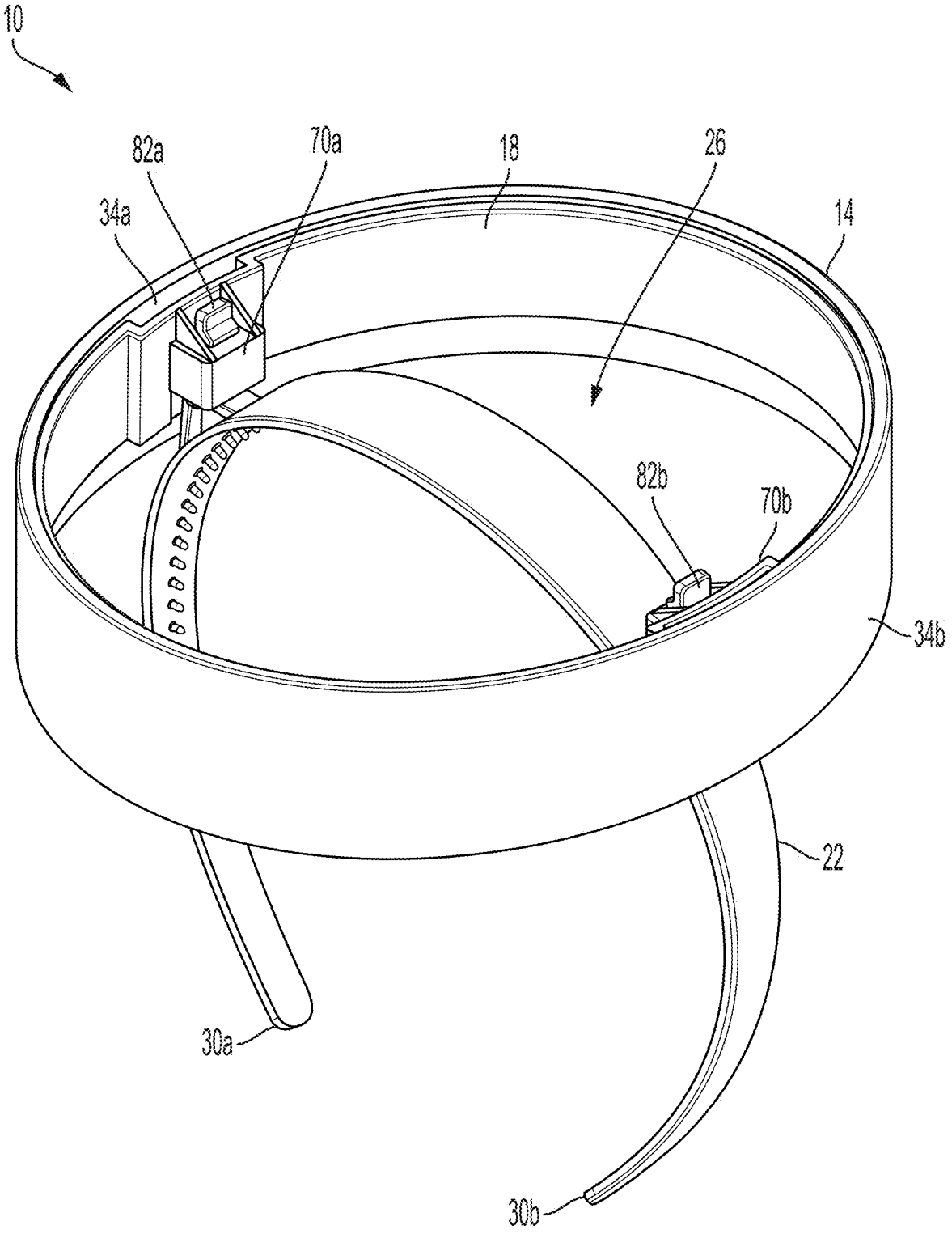
FIGS. 1B-1F depict perspective, front, left, top, and bottom views, respectively, of the system of FIG. 1A when the system is assembled.
Figure 1C:
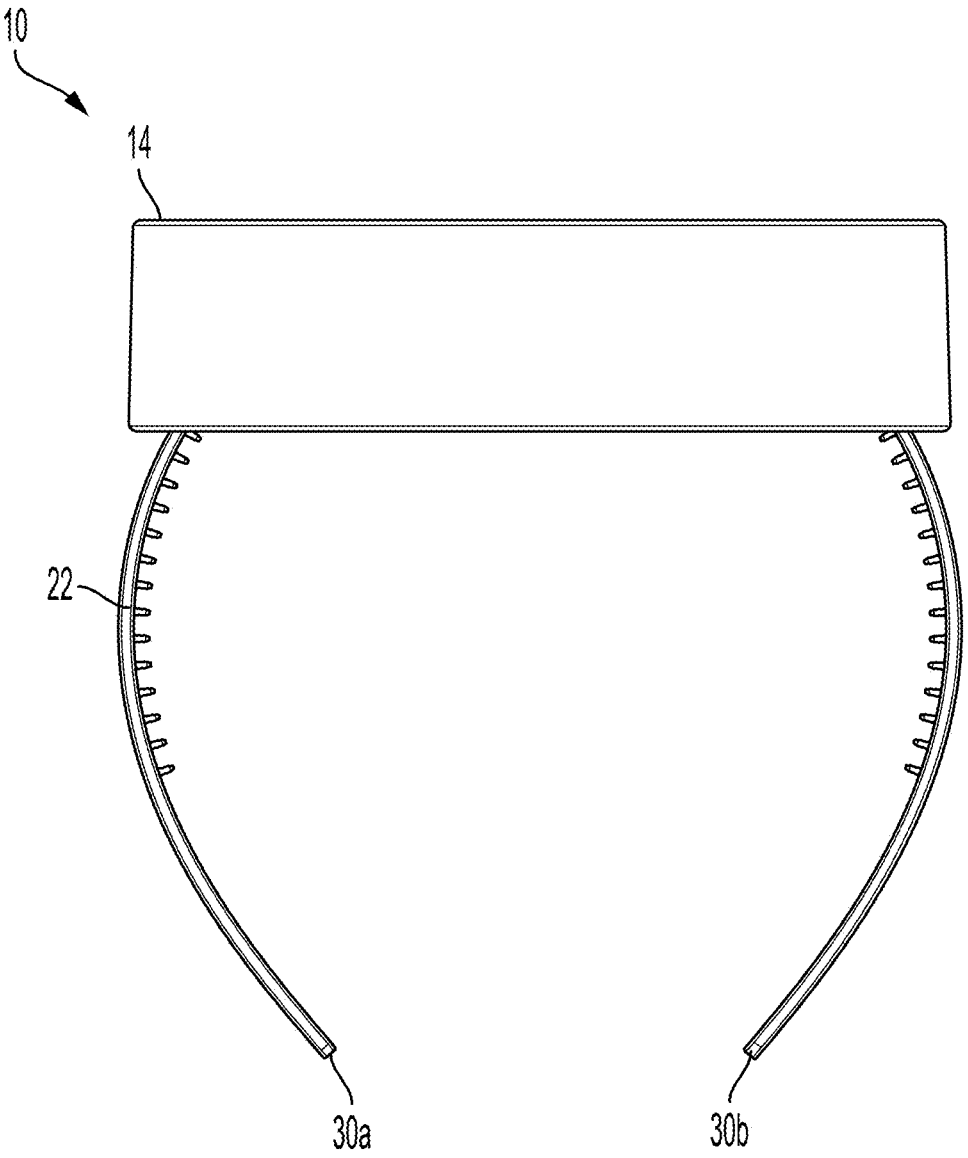
Figure 1D:
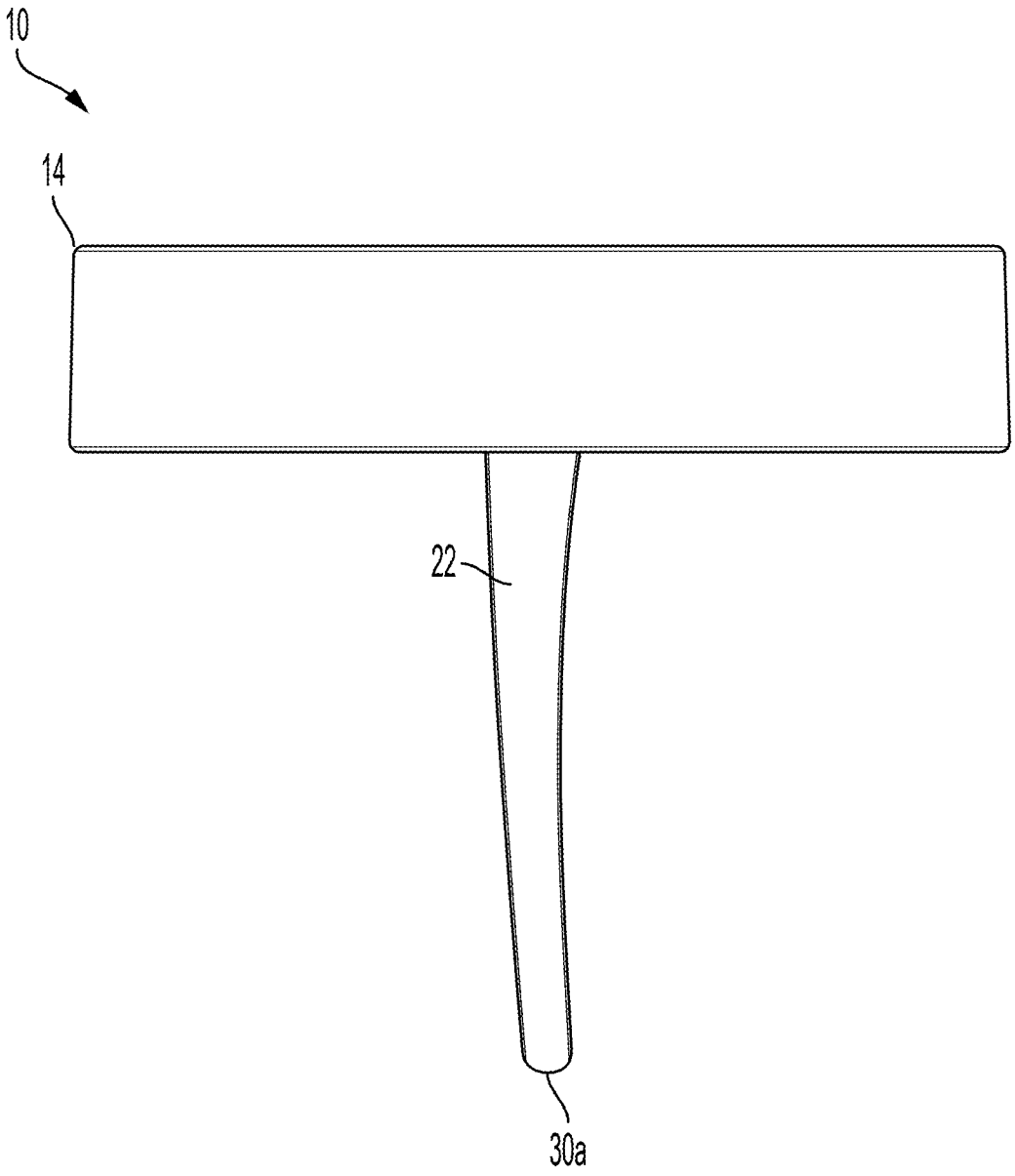
Figure 1E:
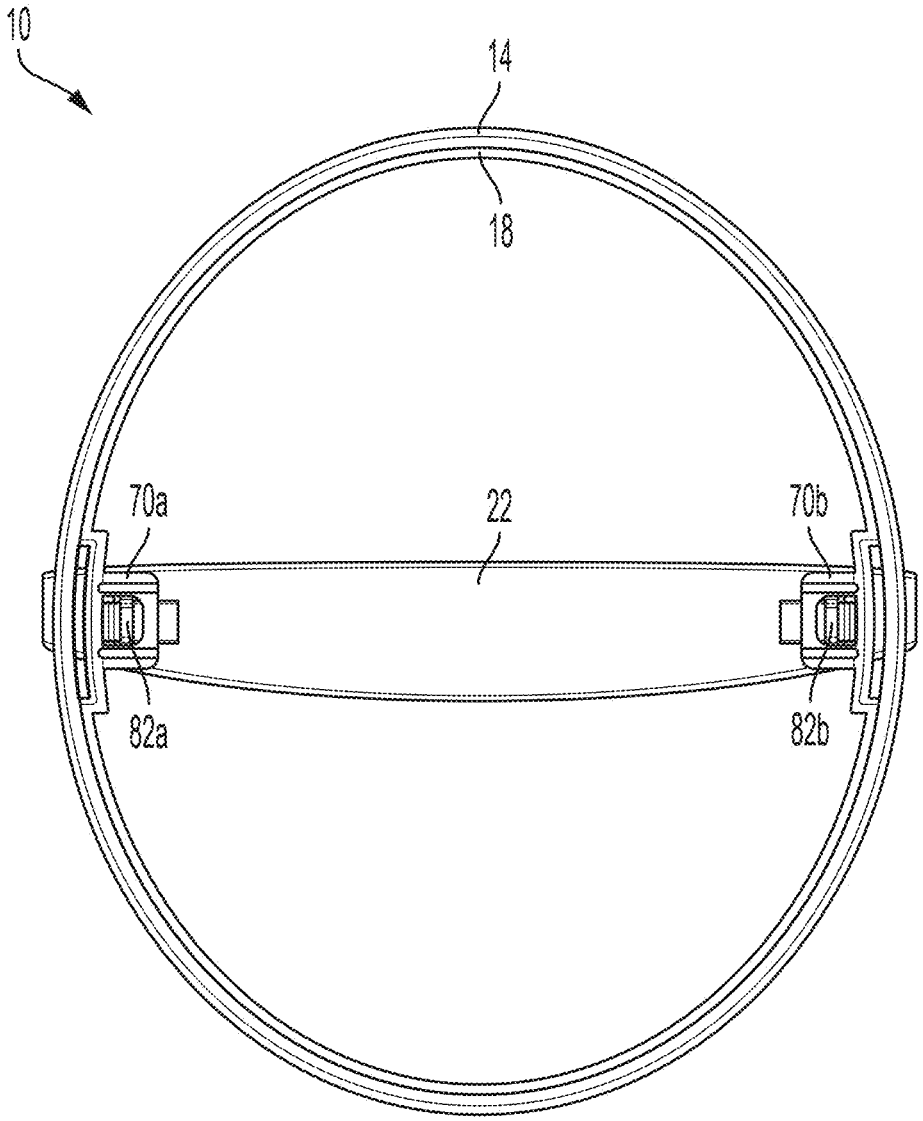
Figure 1F:
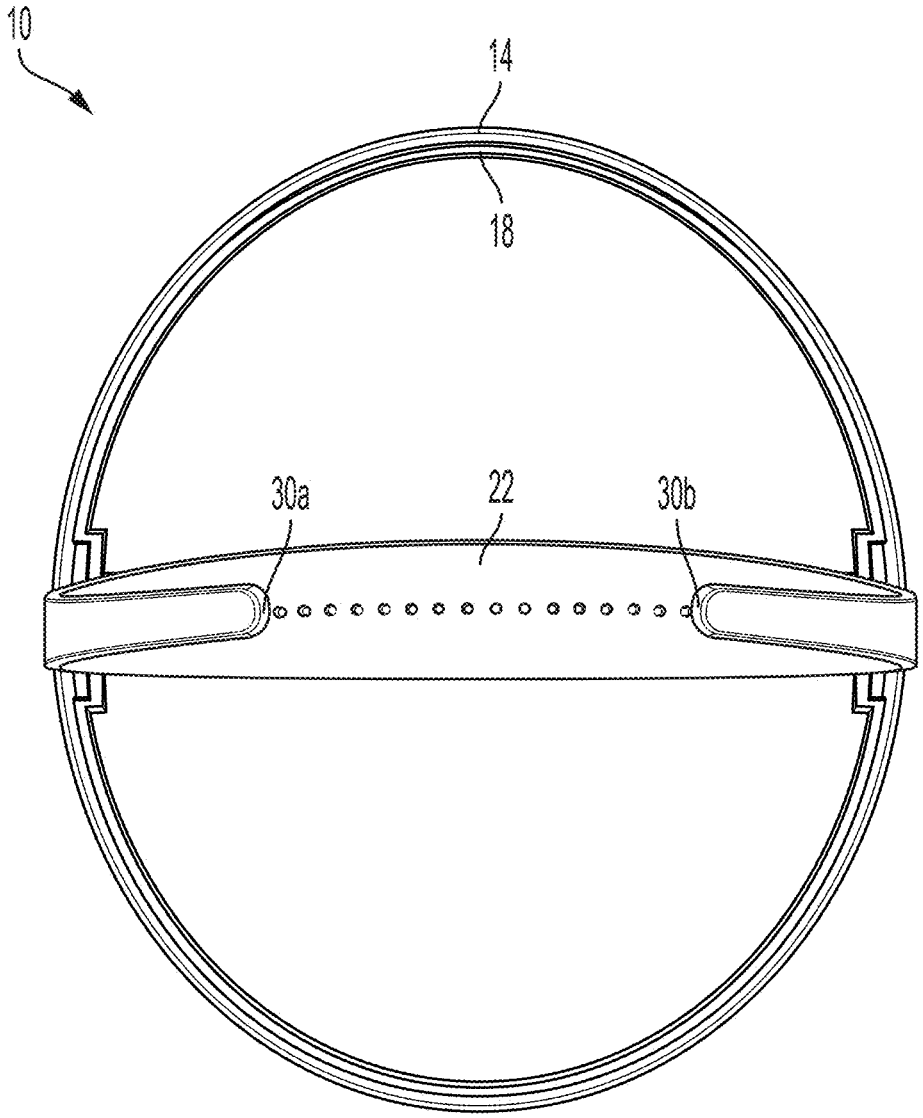
Figure 2A:
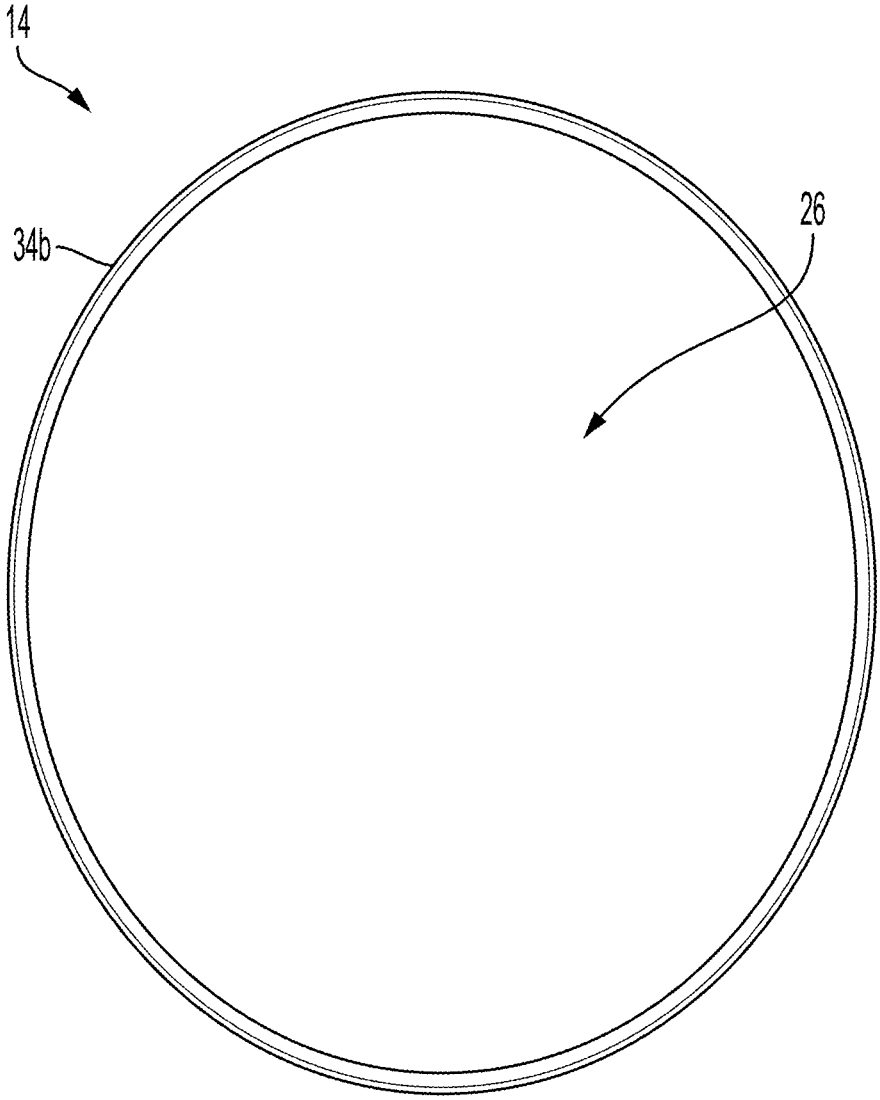
FIGS. 2A-2D depict top, bottom, left, and front views, respectively, of the outer ring of the system of FIG. 1A.
Figure 2B:
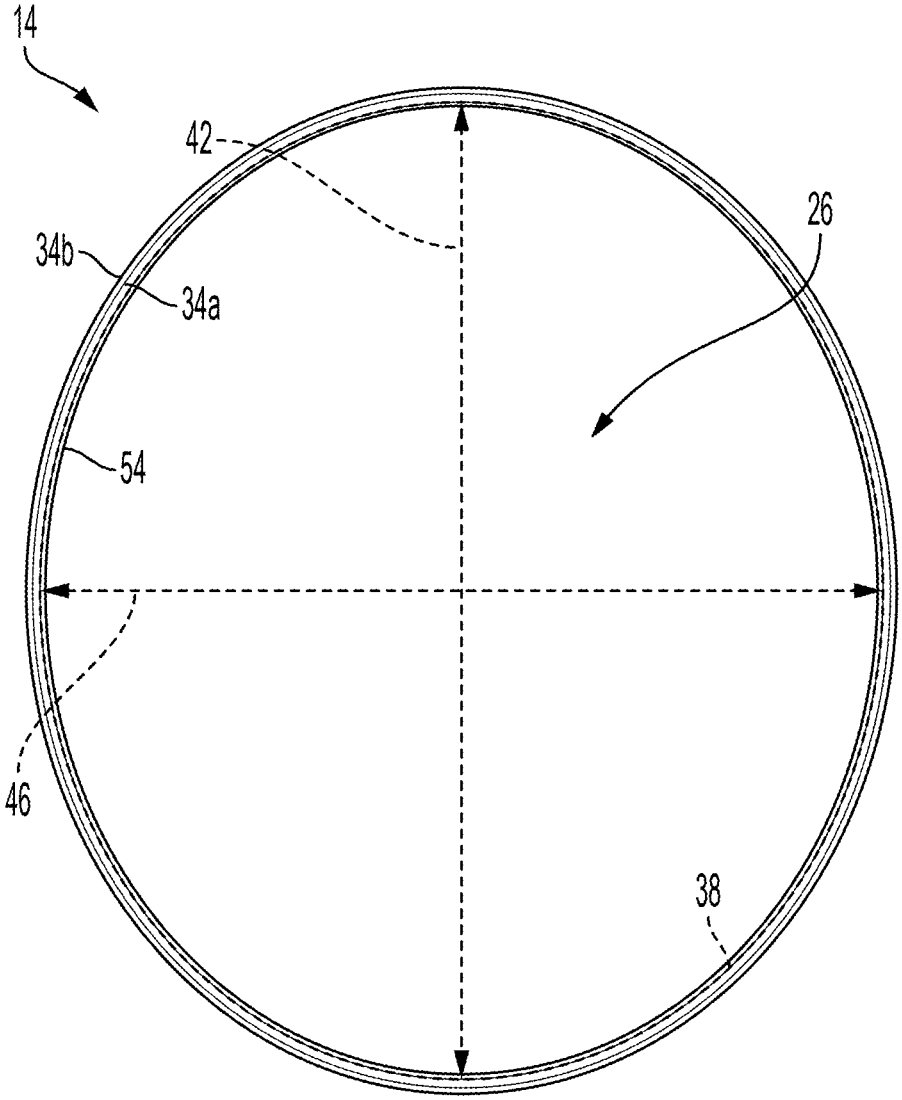
Figure 2C:
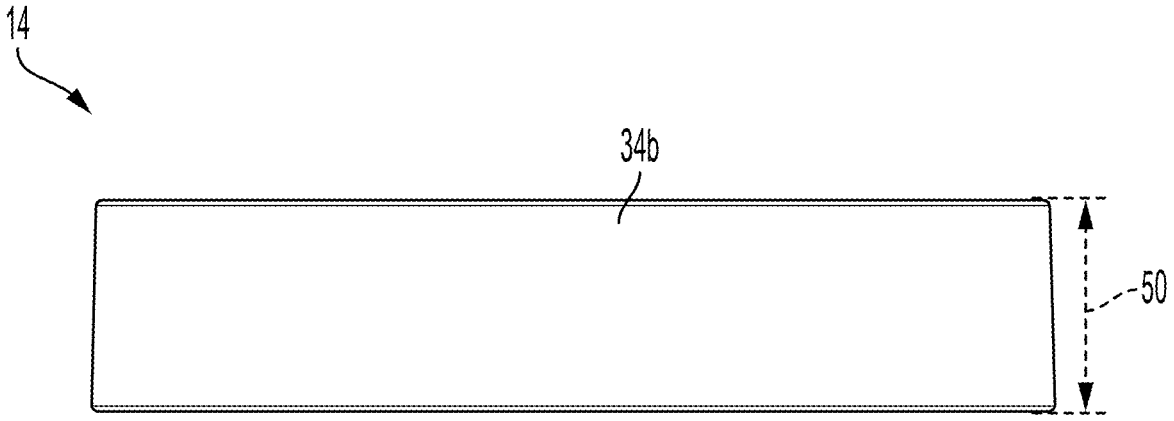
Figure 2D:
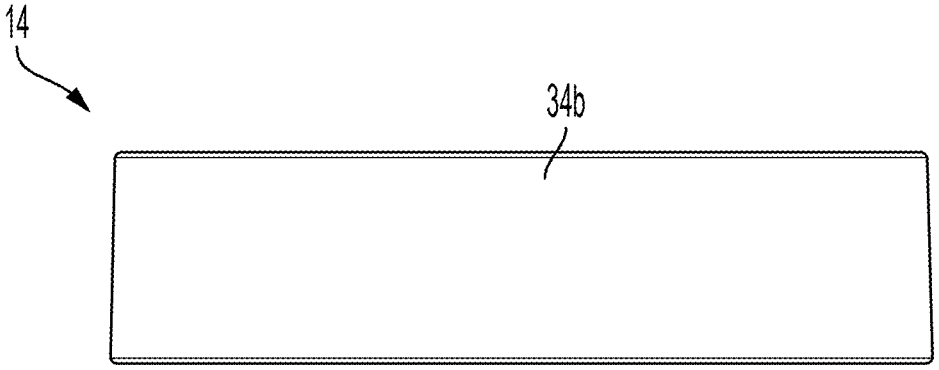
Figure 3A:
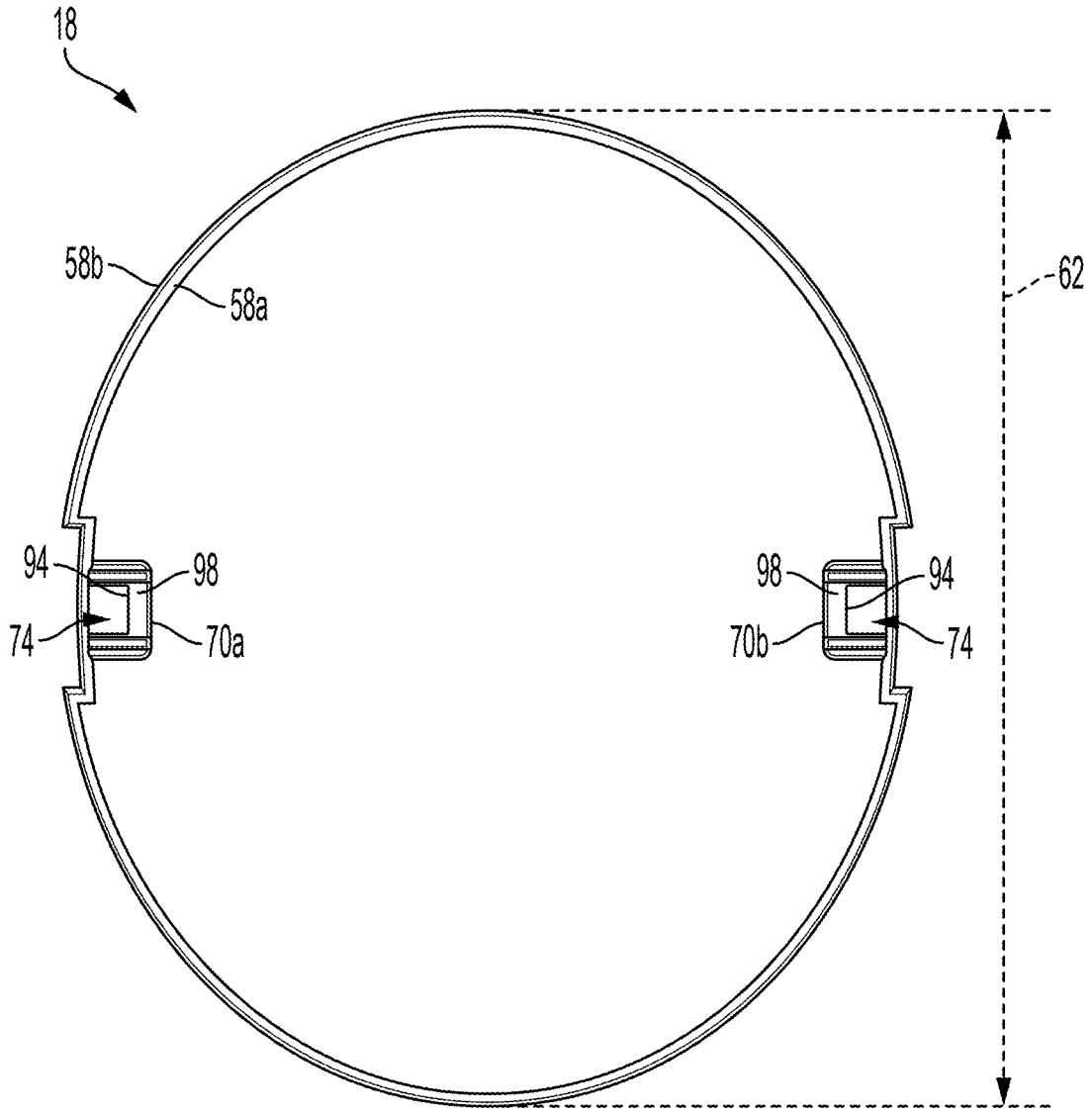
FIGS. 3A-3D depict top, bottom, left, and front views, respectively, of the inner ring of the system of FIG. 1A.
Figure 3B:
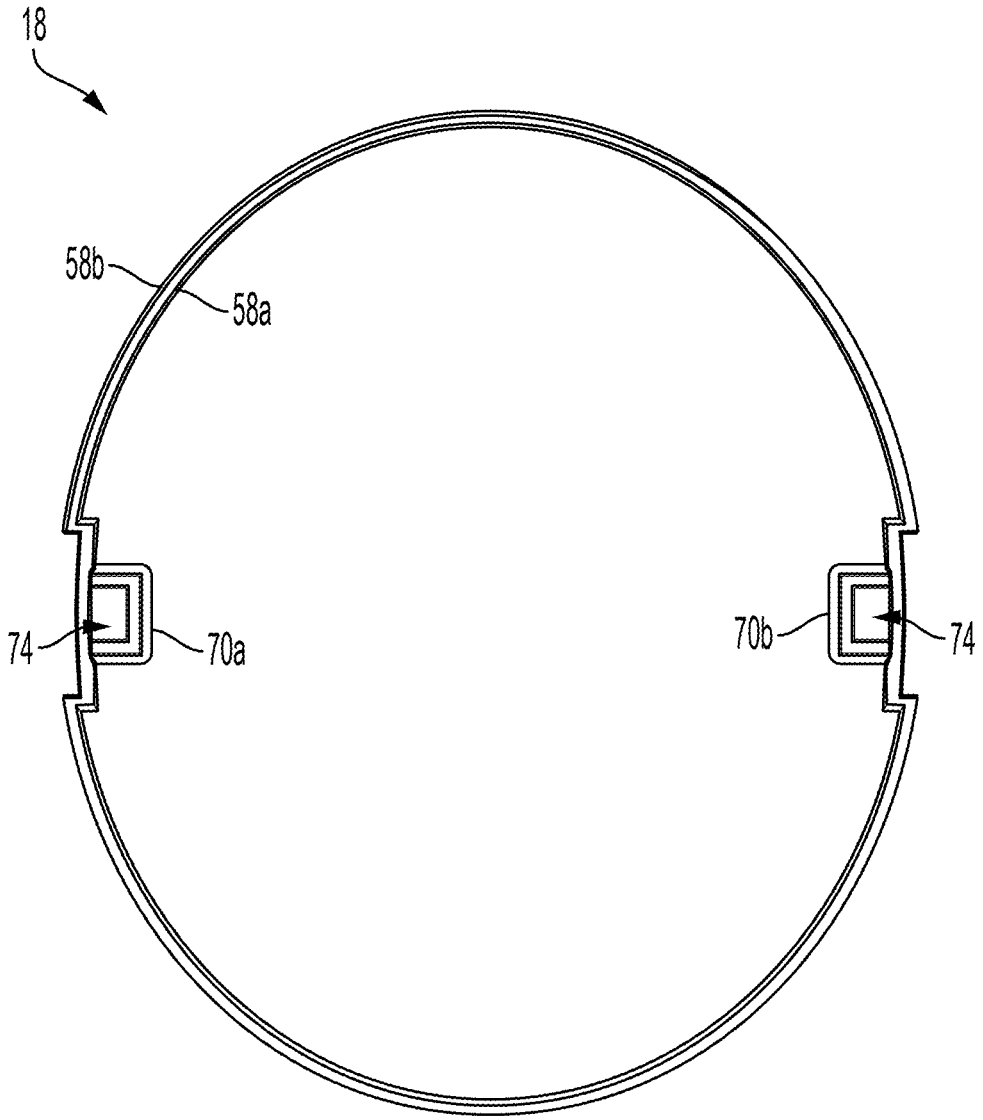
Figure 3C:
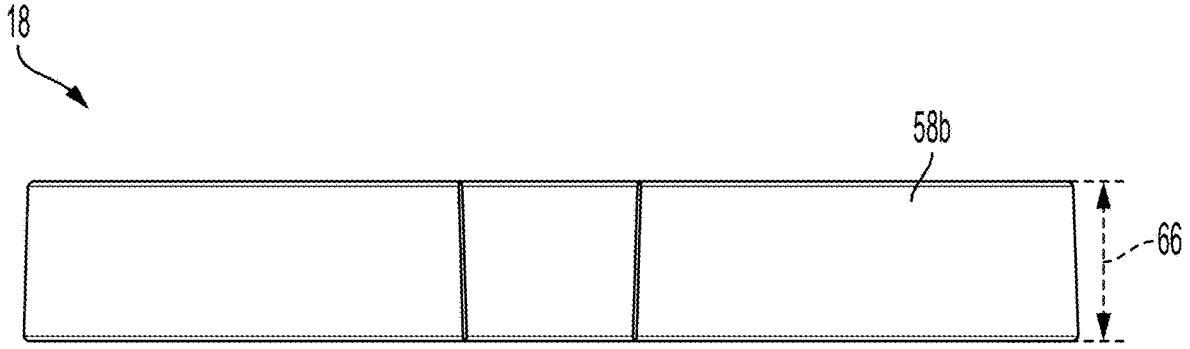
Figure 3D:
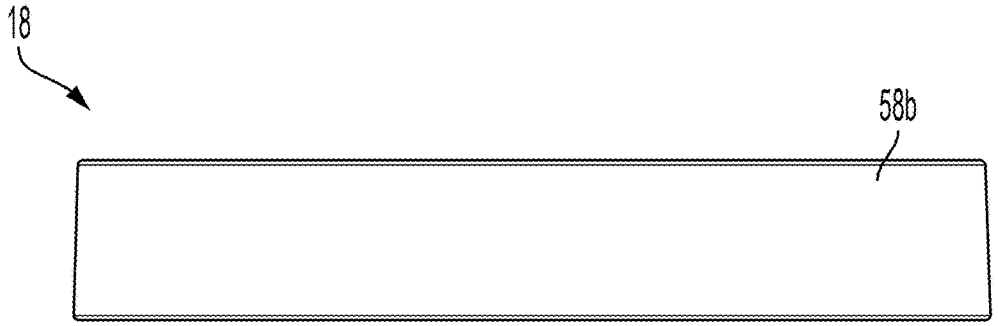

Referring now to the drawings, FIGS. 1A-1F depict an embodiment 10 of the present headwear securing systems.

Figure 9A:
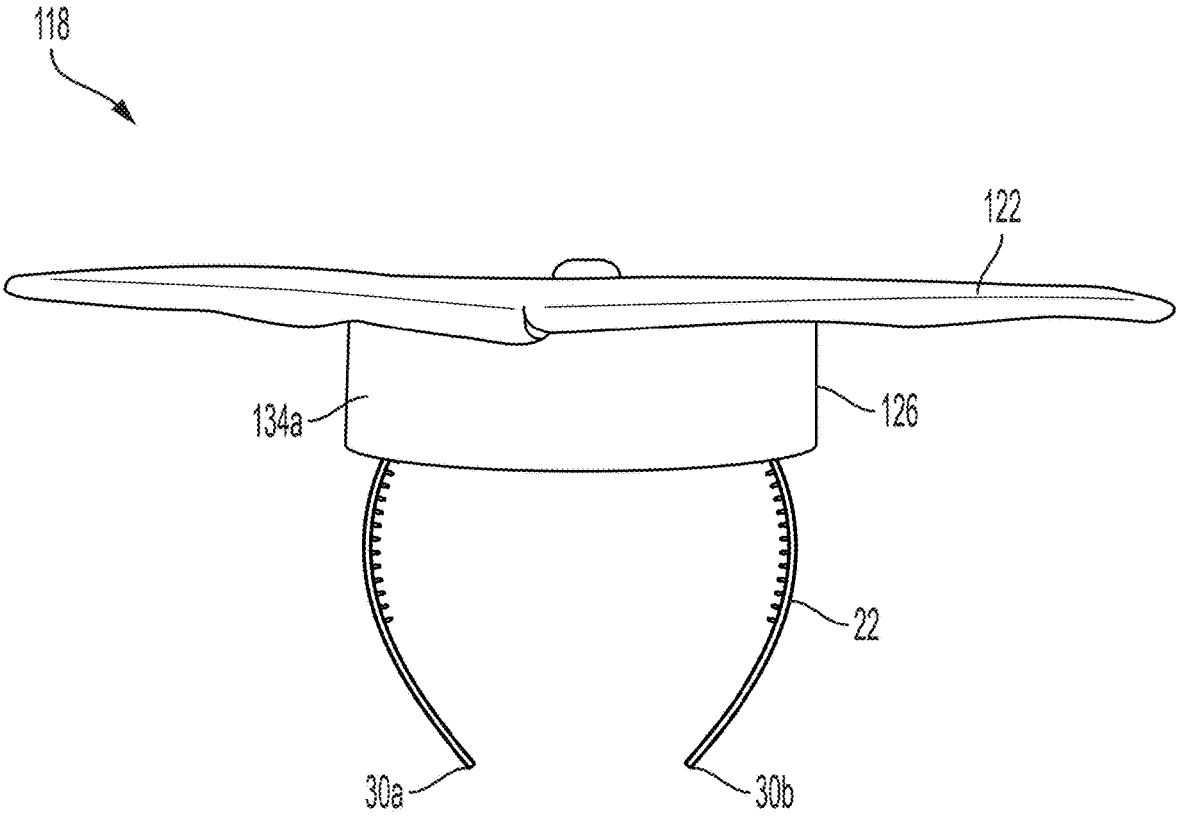
FIGS. 9A and 9B depict front and right views, respectively, of the academic cap of FIGS. 7A-7D with the headwear securing system of FIG. 1A installed pursuant to the process depicted in FIGS. 8A-8D.
Figure 9B:
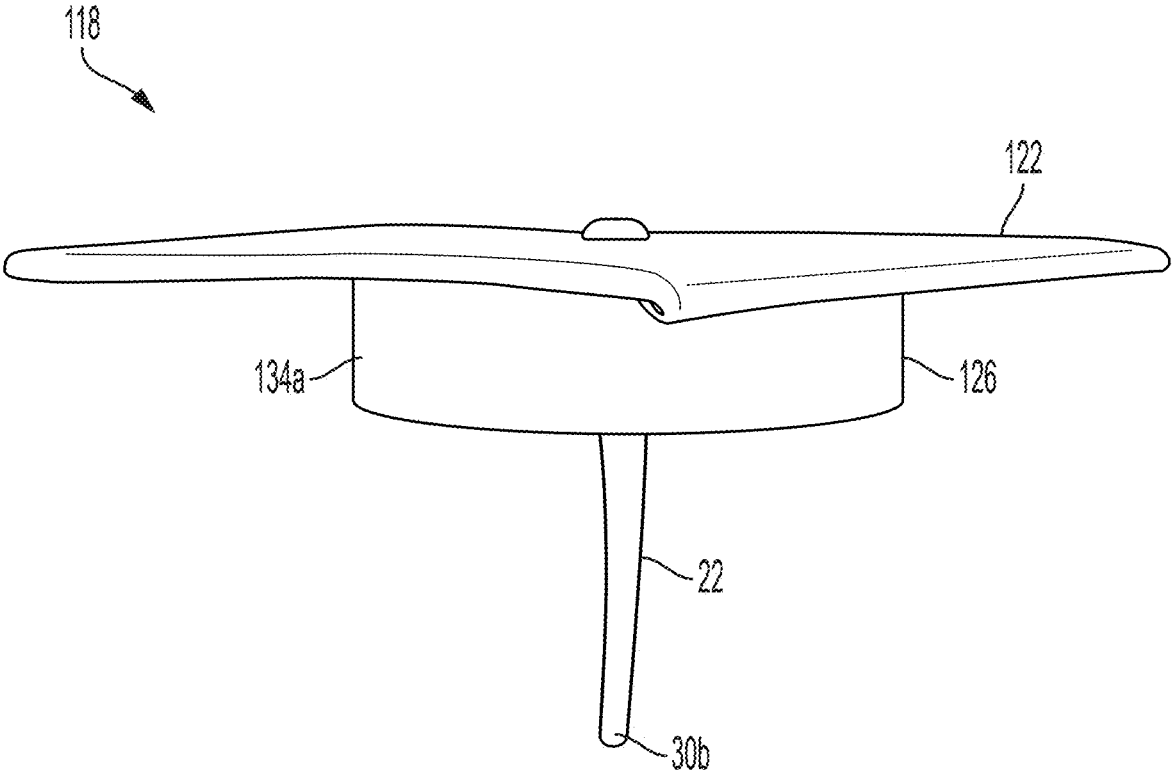

Headwear securing system 10 can be configured to secure an otherwise ill-fitting piece of headwear neatly to a wearer's head by acting as an interface between the two. In accordance with this objective, headwear securing system 10 can be designed such that, when the system is installed in a piece of headwear, it can securely, neatly, and comfortably hold the headwear in place on the wearer's head, and can do so for wearers having differently-sized heads. To achieve these results, headwear securing system 10 can comprise an outer ring 14, an inner ring 18, a headband 22, and one or more tabs 82*a* and 82*b*. As described in further detail below, inner ring 18 can be configured to be received in a volume 26 circumscribed by outer ring 14, and each of tab(s) 82*a* and 82*b* can be coupled to headband 22 and can be configured to be received in a receiving space 94 defined by a respective one of one or more receptacles 70*a* and 70*b* of the inner ring to couple the headband to the inner ring. In this assembled configuration, outer and inner rings 14 and 18 can couple headwear securing system 10 to a piece of headwear that can accordingly be worn via headband 22, like as shown and described in further detail below with reference to FIGS. 9A and 9B when the system is installed in an academic cap 118.

Referring now to FIGS. 2A-2D, outer ring 14 can comprise opposing inner and outer surfaces 34*a* and 34*b*, respectively, and can have a shape that allows it to fit within a cavity of a piece of headwear and to be well-proportioned relative to a head of a wearer. For example, outer ring 14 can be shaped such that volume 26 circumscribed by the outer ring can have an elliptical cross-section, which can promote the outer ring's ability to neatly fit in the cavity of a piece of headwear such as in the skullcap of an academic cap. A maximum transverse dimension 42 of volume 26—which, when the volume has an elliptical cross-section, can be the major axis of the elliptical cross-section—can be greater than or equal to any one of, or between any two of, 12, 12.25, 12.5, 12.75, 13, 13.25, 13.5, 13.75, 14, 14.25, 14.5, 14.75, 15, 15.25, 15.5, 15.75, or 16 centimeters (e.g., preferably between 13.5 and 14.5 centimeters, such as about 14 centimeters). And, if not having a circular cross-section, volume 26 can have a minimum transverse dimension 46—which, when the volume has an elliptical cross-section, can be the minor axis of the elliptical cross-section—can be greater than or equal to any one of, or between any two of, 10, 10.25, 10.5, 10.75, 11, 11.25, 11.5, 11.6, 11.8, 12, 12.5, 12.75, 13, 13.25, 13.5, 13.75, or 14 centimeters (e.g., preferably between 11.5 and 12.5 centimeters, such as about 12 centimeters). Furthermore, a heigh 50 of outer ring 14 can be greater than or equal to any one of, or between any two of, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, or 3 centimeters (e.g., preferably between 1.5 and 2.5 centimeters, such as about 2 centimeters). Such dimensions of the volume 26 circumscribed by outer ring 14—especially with an elliptical cross-section having a major axis 42 of between 13.5 and 14.5 centimeters and a minor axis 46 of between 11.5 and 12.5 centimeters—can allow the outer ring to fit within the cavity of a piece of headwear such as an academic cap and can render the outer ring well-proportioned relative to the head of a wearer.

Figure 4:
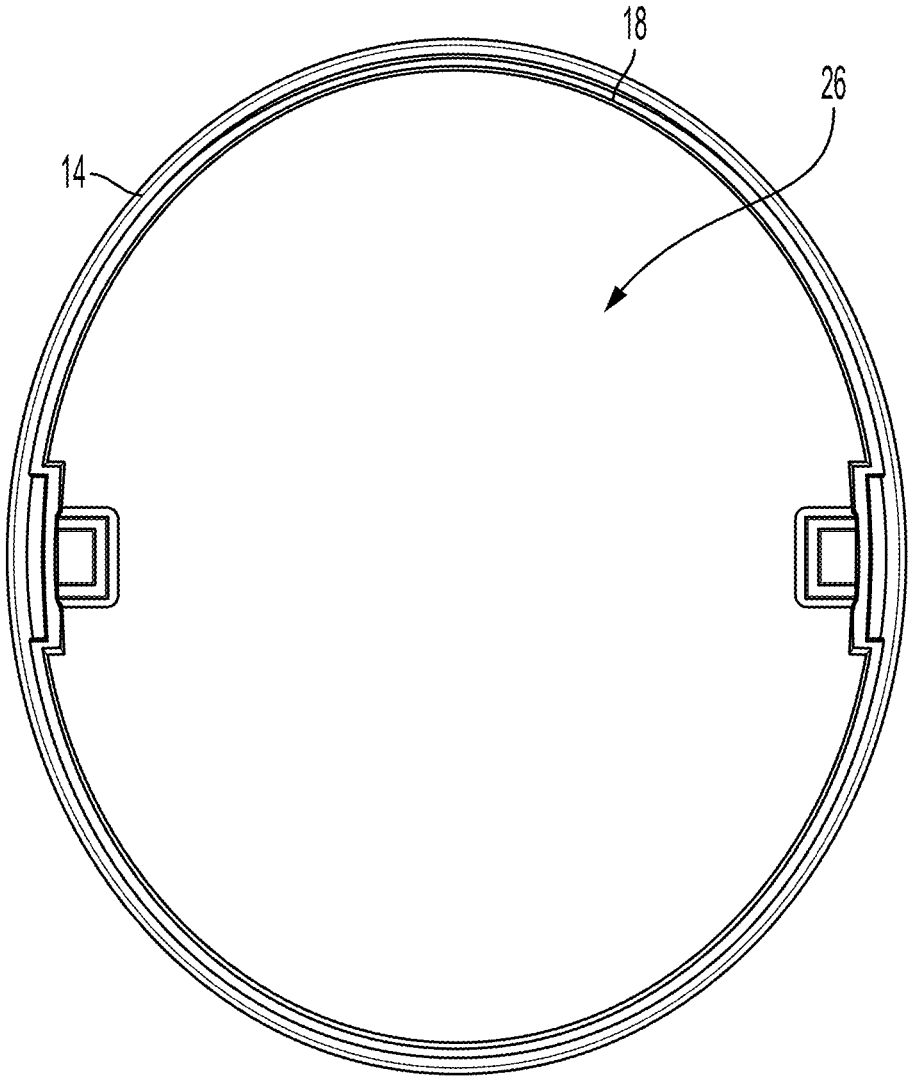
FIG. 4 depicts a bottom view of the outer and inner rings of FIGS. 2A-2D and 3A-3D, respectively, when the inner ring is disposed in a volume circumscribed by the outer ring.
Figure 5A:
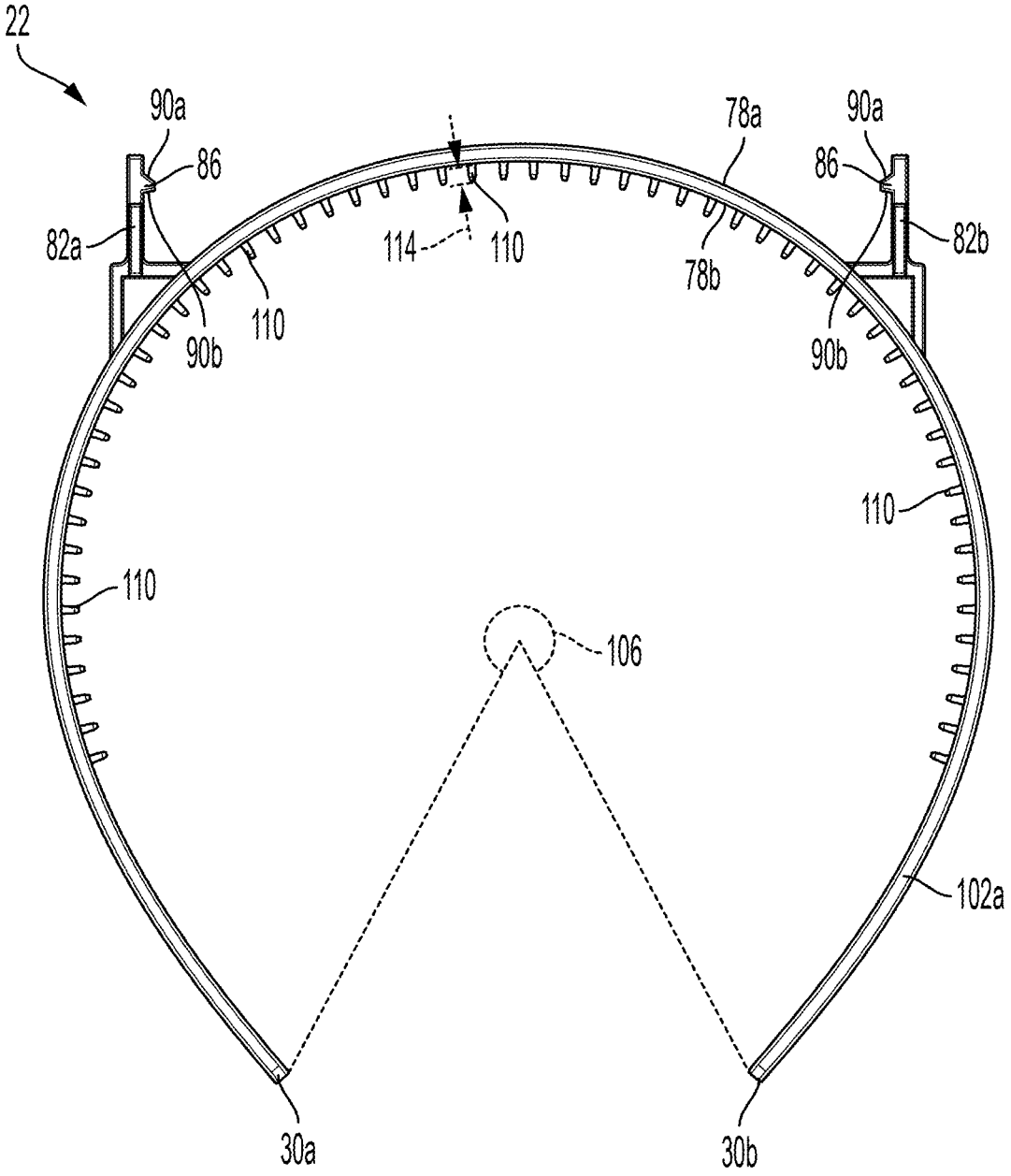
FIGS. 5A-5F depict front, rear, left, right, top, and bottom views, respectively, of the headband of the system of FIG. 1A.
Figure 5B:
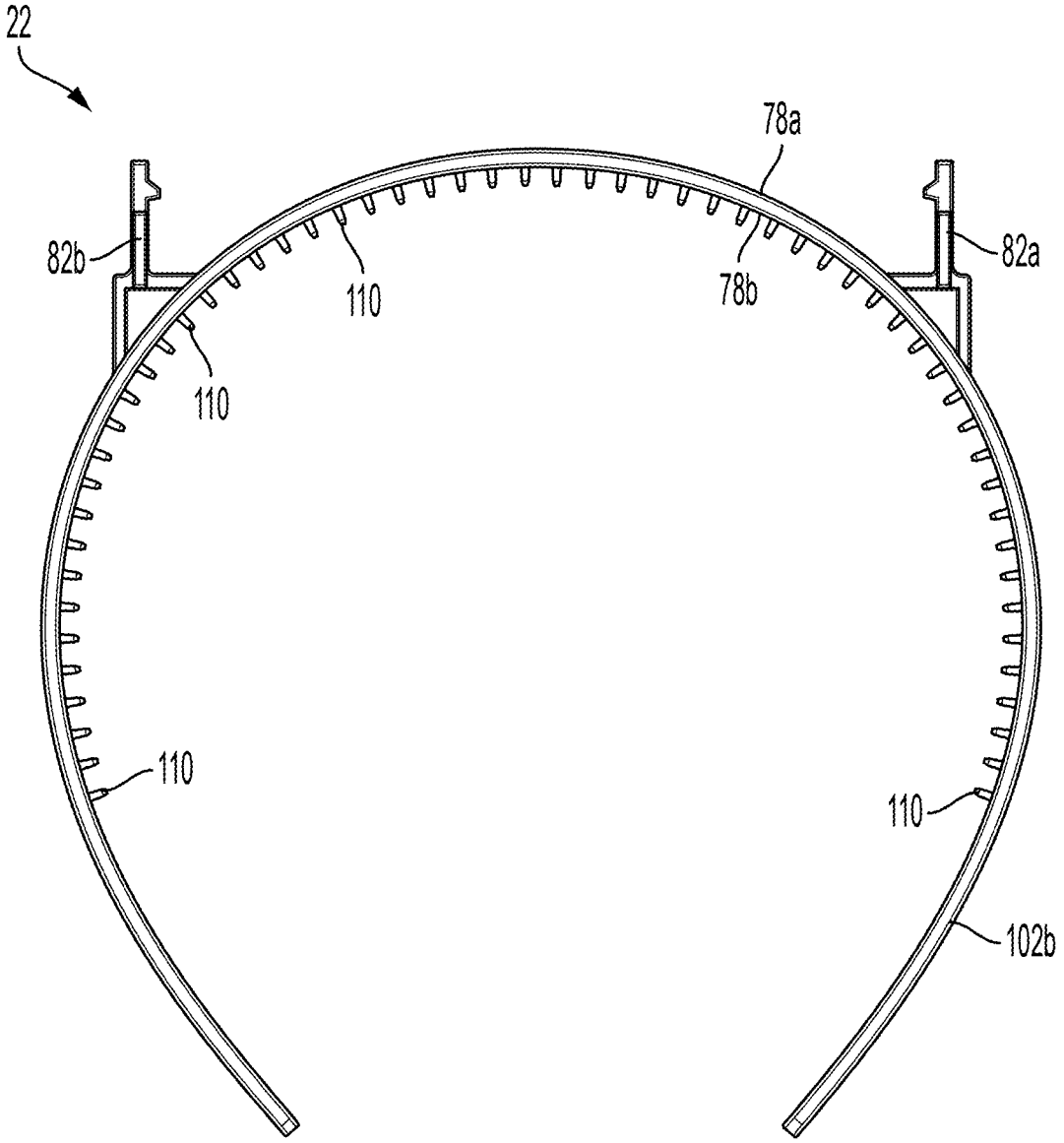
Figure 5C:
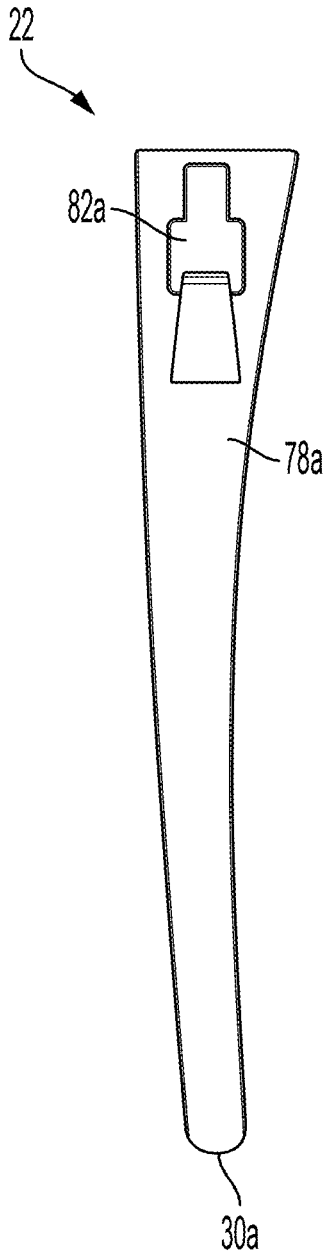
Figure 5D:
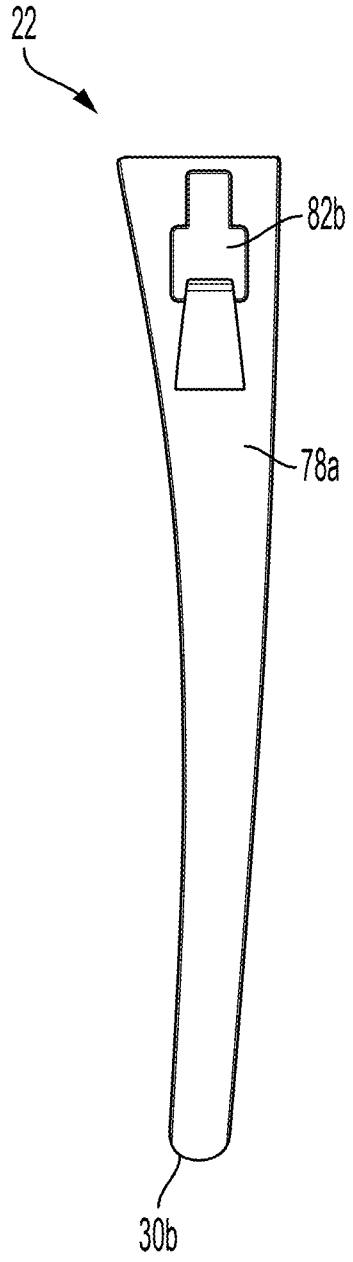
Figure 5E:
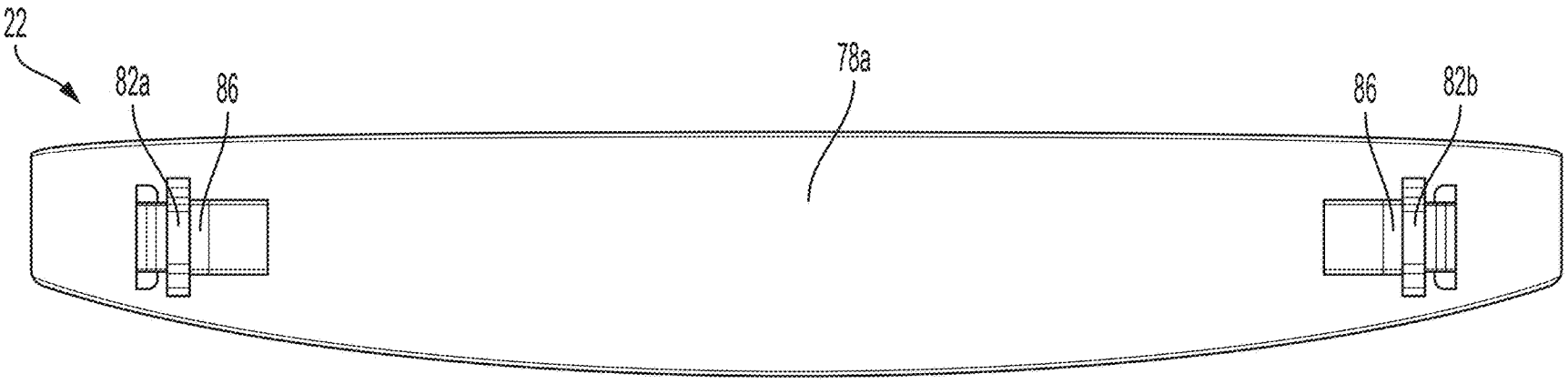
Figure 5F:
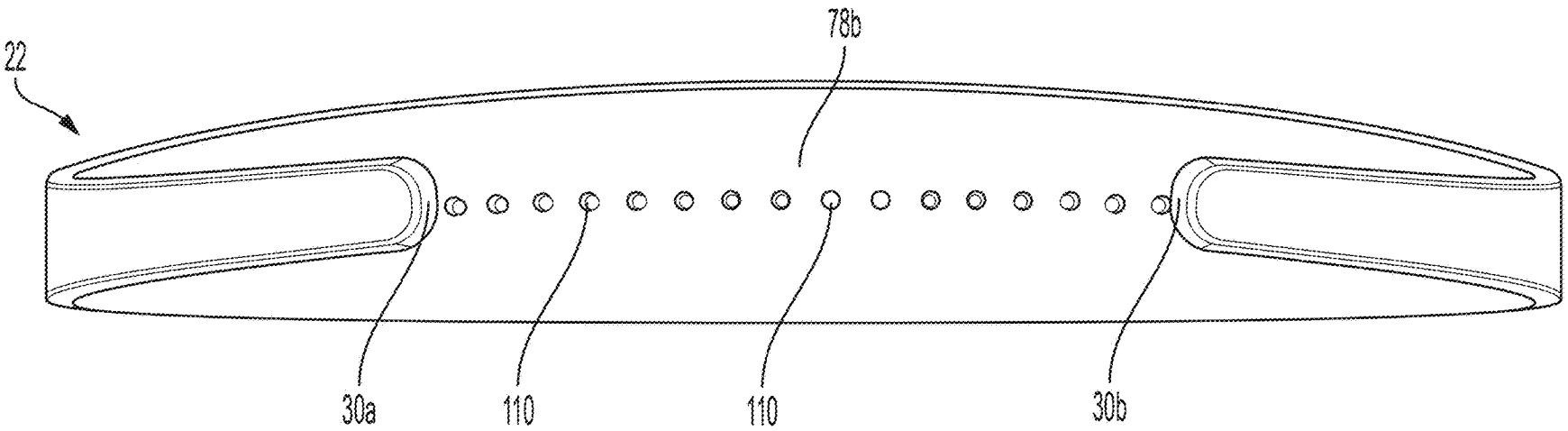

Referring additionally to FIGS. 3A-3D and 4, as noted above inner ring 18, which can have opposing inner and outer surfaces 58*a* and 58*b*, can be shaped such that it can fit in volume 26 circumscribed by outer ring 14 so that, as shown in FIG. 4, the inner ring's outer surface can face the outer ring's inner surface 34*a*. To do so, maximum transverse dimension 62 of inner ring 18 can be less than maximum transverse dimension 42 of volume 26 circumscribed by outer ring 14. Preferably, inner ring 18 is sized similarly to outer ring 14 to allow for a secure fit between the inner and outer rings while still maintaining enough distance between the two components to secure headwear material in between the two. For example, maximum transverse dimension 62 of inner ring 18 can be within any one of, or between any two of, 1%, 2%, 3%, 4%, or 5% (e.g., within 5%) of maximum transverse dimension 42 of volume 26 circumscribed by the outer ring 14, which—in addition to promoting a secure fit between the two components when installed in a piece of headwear—can facilitate alignment of the rings such that they have the desired orientation. Furthermore, when inner ring 18 is received in volume 26 circumscribed by the outer ring 14, along at least a majority of outer surface 58*b* of the inner ring, a distance 66 between the outer surface of the inner ring and inner surface 34*a* of the outer ring can be less than or equal to any one of, or between any two of, 3, 2.5, 2, 1.5, or 1 millimeters.

As shown, outer ring 14 can additionally comprise a lip 54 coupled to and extending away from the inner surface 34*a* of the outer ring. Inner ring 18 can then be configured to abut lip 54 of outer ring 14 when the inner ring is received in volume 26 circumscribed by the outer ring, which can allow the outer ring to support the inner ring when no headwear material is securely placed between the two components (e.g., such that the inner ring can rest on the lip so that it does not fall out of the volume when handled before installation on a piece of headwear).

Referring further to FIGS. 5A-5F, headband 22 of headwear securing system 10—which, as noted above, can be configured to be coupled to inner ring 18—can be shaped and sized to be worn on the head of a wearer. Because headband 22 can better fit on differently-sized heads than conventional one-size-fits-all or one-size-fits-most headwear securing mechanisms, employing the headband to secure headwear securing system 10 and thus a piece of headwear in which the system is installed to a wearer's head can allow a more comfortable, neat, and secure adornment of the headwear. To achieve this fit, headband 22 can comprise first and second ends 30*a* and 30*b*, respectively, opposing upper and lower surfaces 78*a* and 78*b*, respectively, and front and rear edges 102*a* and 102*b*, respectively, that each connect the upper surface to the lower surface and extend between the first and second ends, where the headband can be curved such that the front and rear edges of the headband each subtend an angle 106 that is greater than or equal to 180° between the first and second ends. For example, angle 106 can be greater than or equal to any one of, or between any two of, 180°, 190°, 200°, 210°, 220°, 230°, 240°, 250°, 260°, 270°, 280°, 290°, 300°, 310°, 320°, 330°, or 340° (e.g., at least 270°). Headband curvature about such angles can promote a comfortable yet secure fit around differently-sized heads. Headband 22 can additionally comprise multiple protuberances 110, such as greater than or equal to any one of, or between any two of, 10, 11, 12, 15, 20, 25, 30, 35, 40, 45, 50, 55, or 60 protuberances (e.g., at least 40 protuberances), wherein each of the protuberances can be coupled to and extend away from lower surface 78*b* of the headband. Additionally, each of the protuberances 110 can have a length 114 that is less than or equal to any one of, or between any two of, 0.5, 1, 2, 3, 4, or 5 millimeters (e.g., less than or equal to 5 millimeters). Such protuberances 110 can engage with the wearer's hair, helping secure headband 22 (and thus the remainder of headwear securing system 10 when assembled) to the wearer's head, and with a length that is less than or equal to 5 millimeters can provide adequate headband-to-hair securement while maintaining comfort for the wearer.

As noted above, headwear securing system 10 can comprise one or more tabs 82*a* and 82*b*—which preferably include at least first tab 82*a* and second tab 82*b*—and inner ring 18 can comprise one or more receptacles 70*a* and 70*b*—which preferably include at least first receptacle 70*a* and second receptable 70*b*—such that headband 22 can be coupled to the inner ring. As shown in FIGS. 3A-3D and 5A-5F, tab(s) 82*a* and 82*b* can each be coupled to and extend away from upper surface 78*a* of headband 22, where the tab(s) optionally are integral with the headband, and receptacle(s) 70*a* and 70*b* can each be coupled to inner surface 58*a* of the inner ring and define a receiving space 74. As shown in FIGS. 6A-6G, tab(s) 82*a* and 82*b* and receptacle(s) 70*a* and 70*b* can be positioned such that each of the tab(s) can be configured to be received in receiving space 74 defined by a respective one of the receptacle(s) such that the tab releasably engages the receptacle, thereby securing headband 22 to inner ring 18.

Figure 6A:
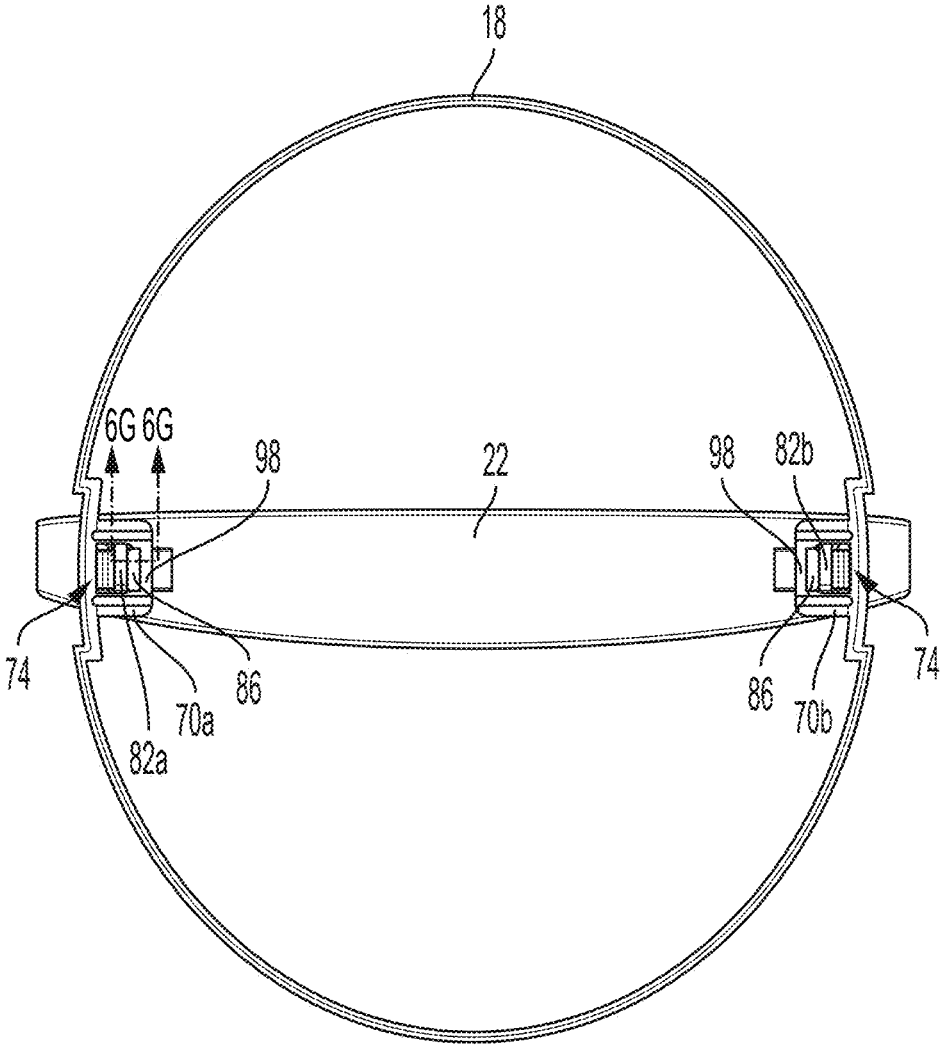
FIGS. 6A-6F depict top, bottom, left, right, front, and rear views, respectively, of the inner ring and headband of FIGS. 3A-3D and 5A-5F, respectively, assembled together.
Figure 6B:
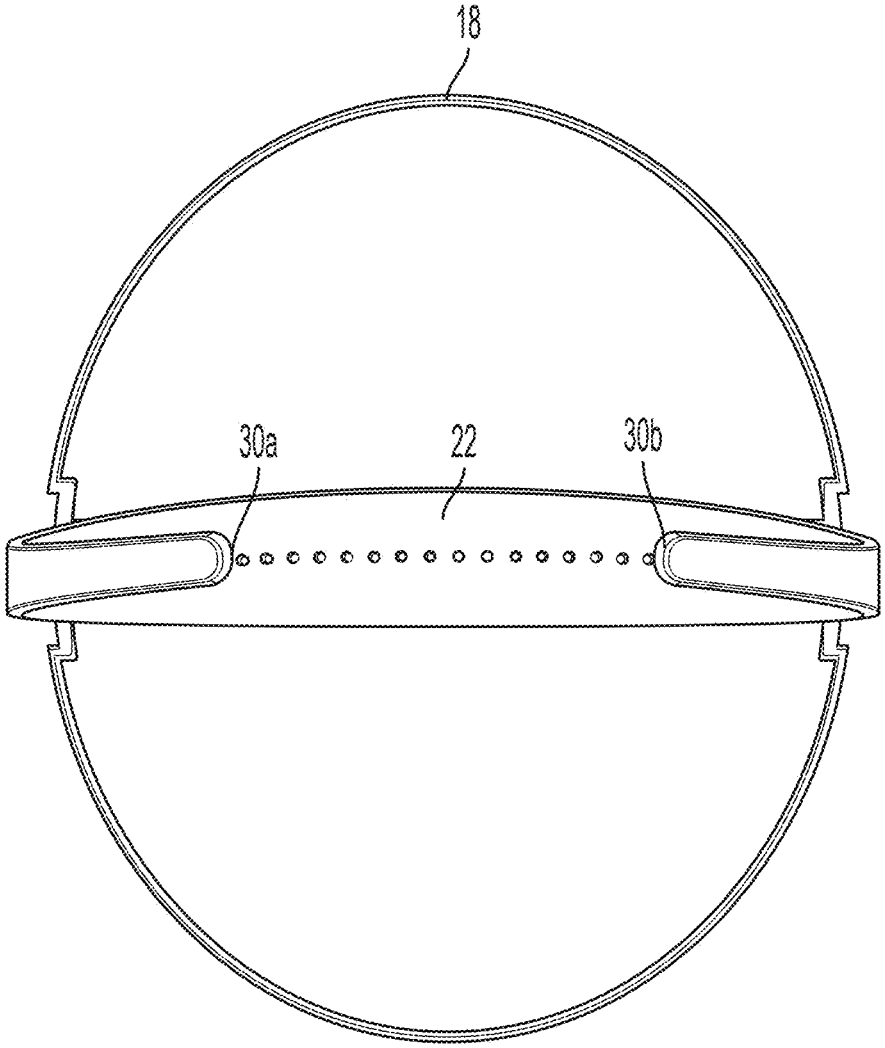
Figure 6C:
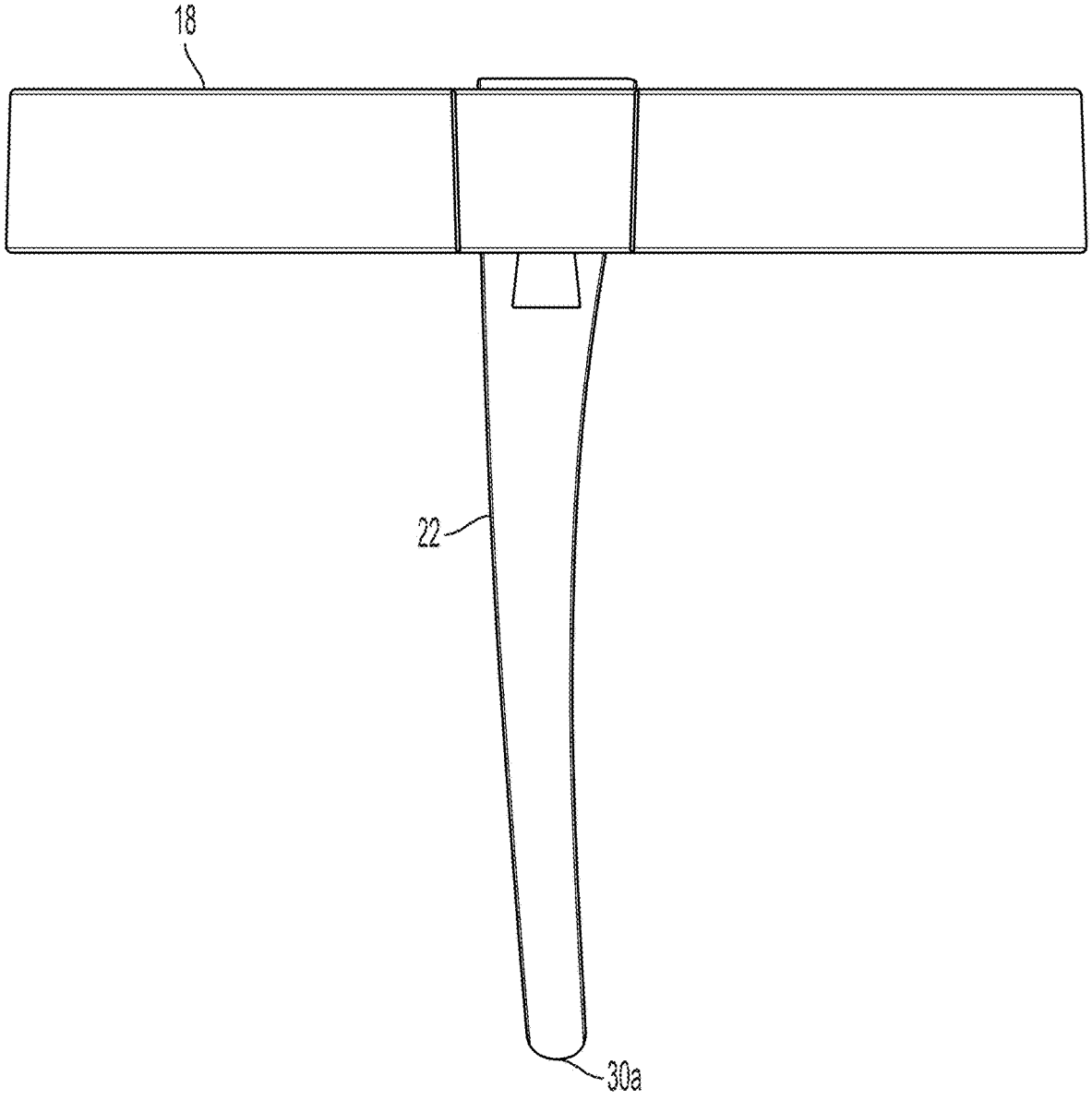
Figure 6D:
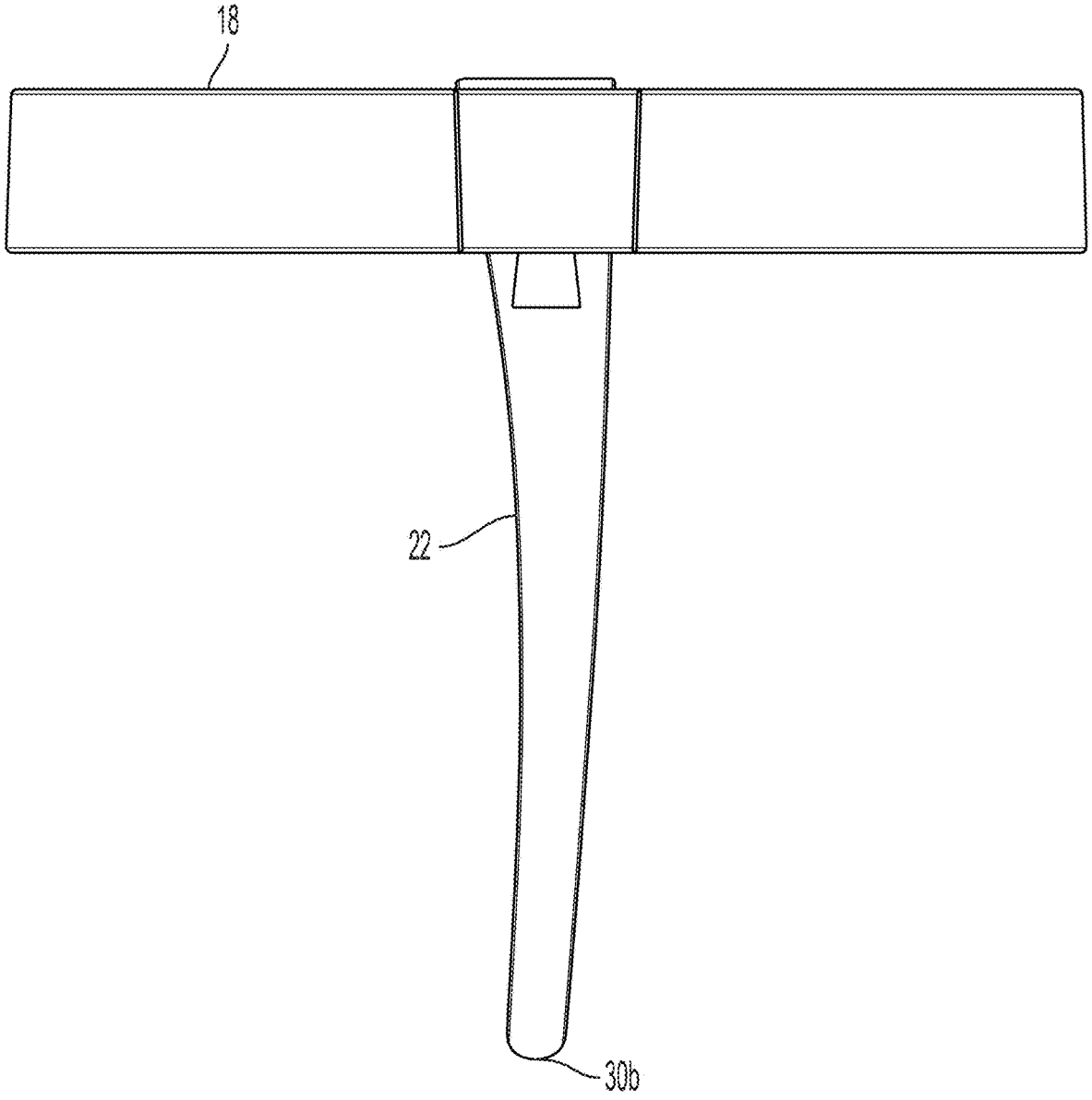
Figure 6E:
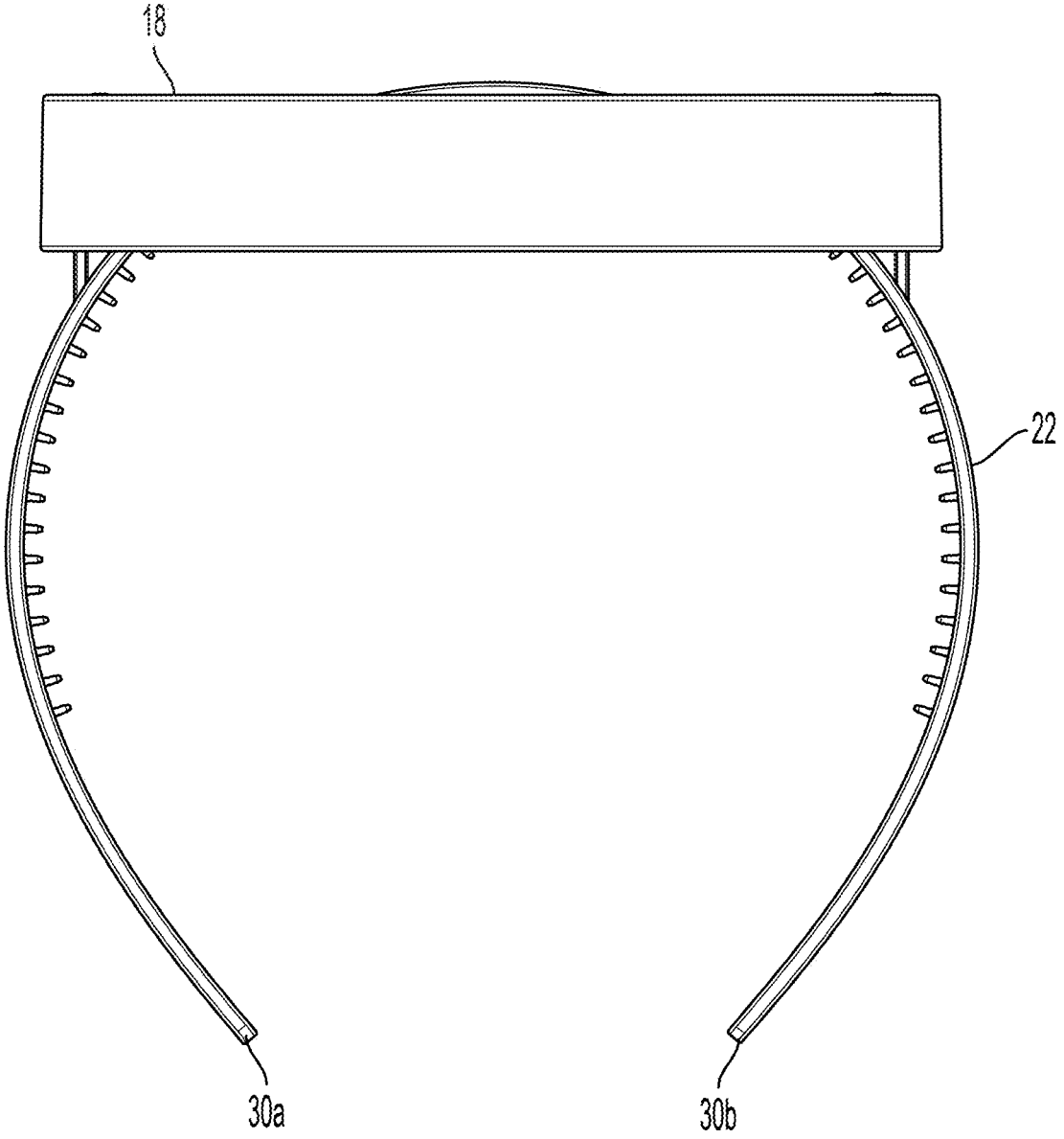
Figure 6F:
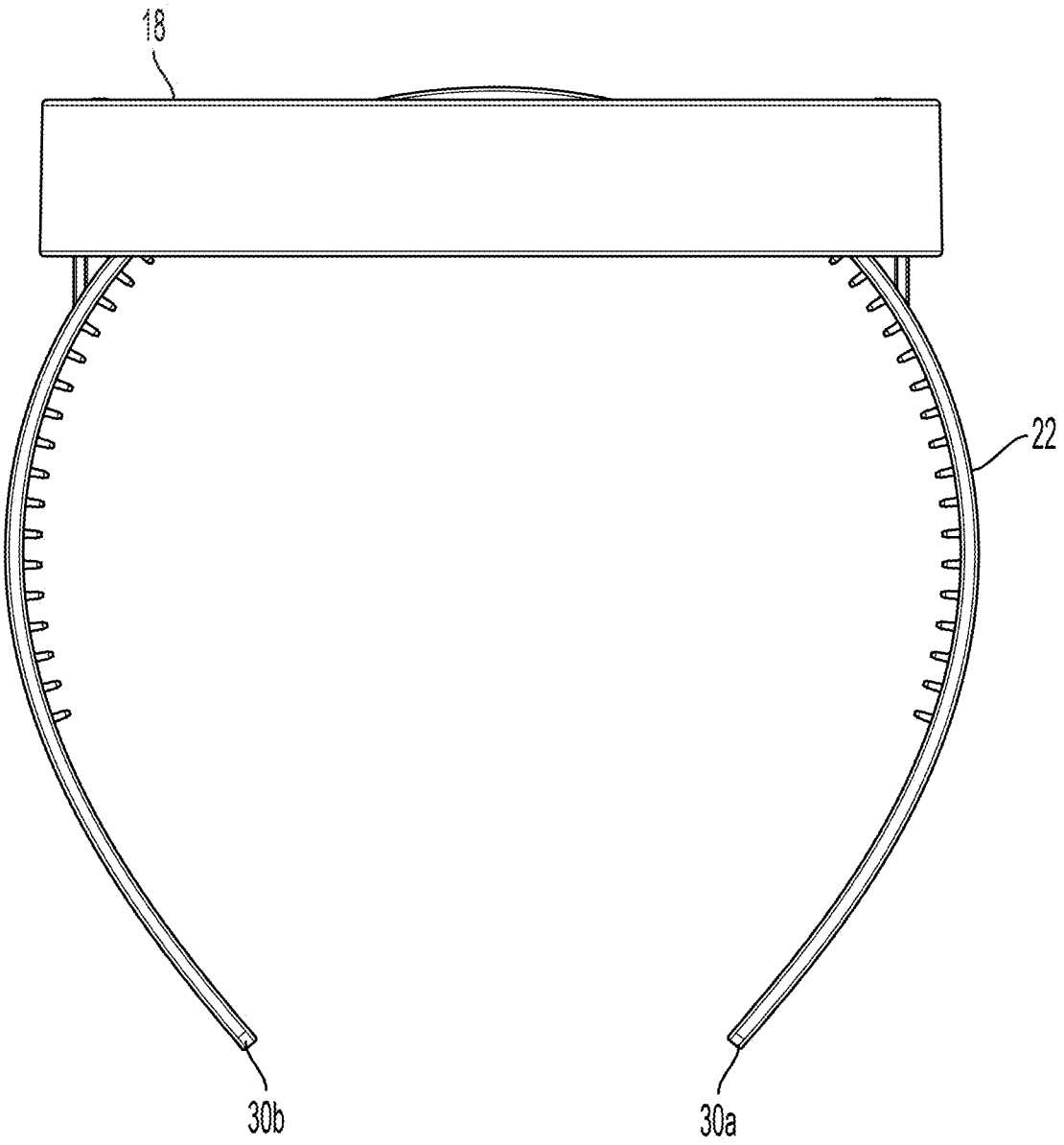
Figure 6G:
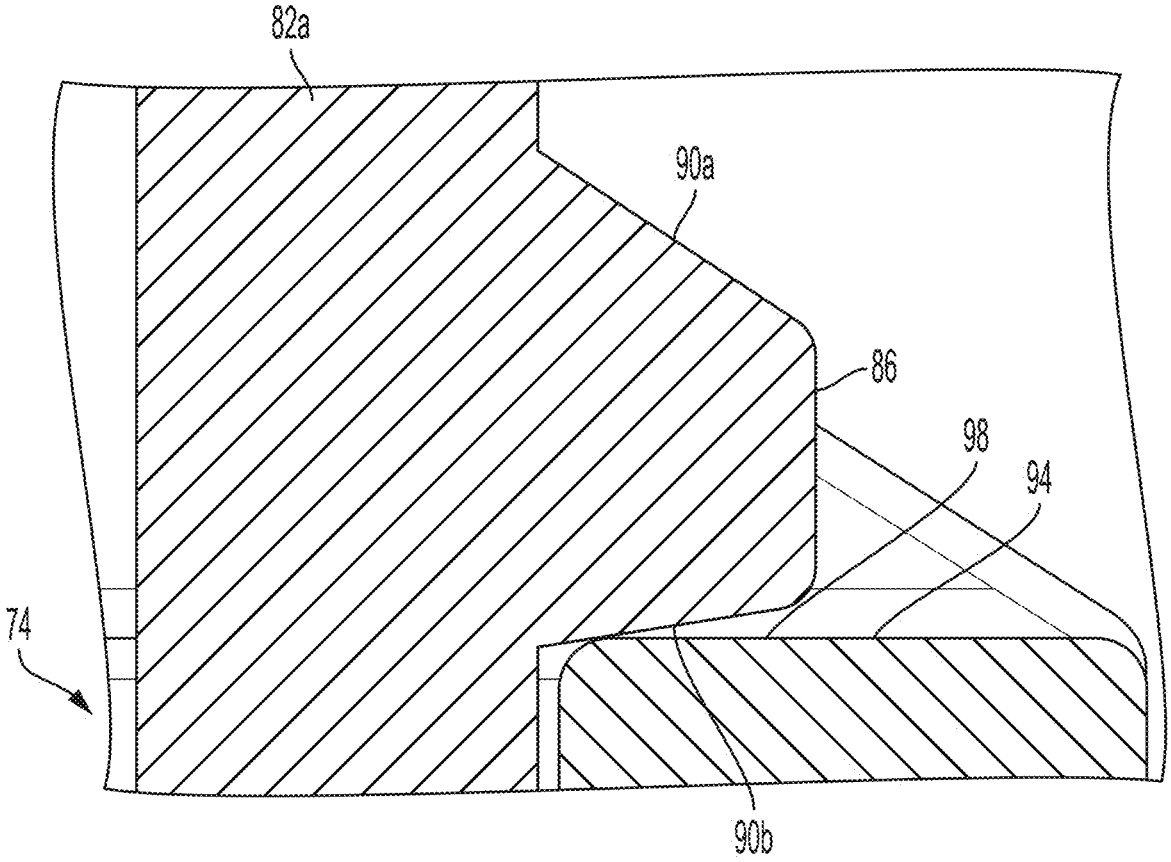
FIG. 6G depicts a cross-sectional view of the assembly of FIGS. 6A-6F taken along line 6G-6G from FIG. 6A. This view highlights the tab-and-receptacle system used to connect the headband of FIGS. 5A-5F to the inner ring of FIGS. 3A-3D.
Figure 7A:
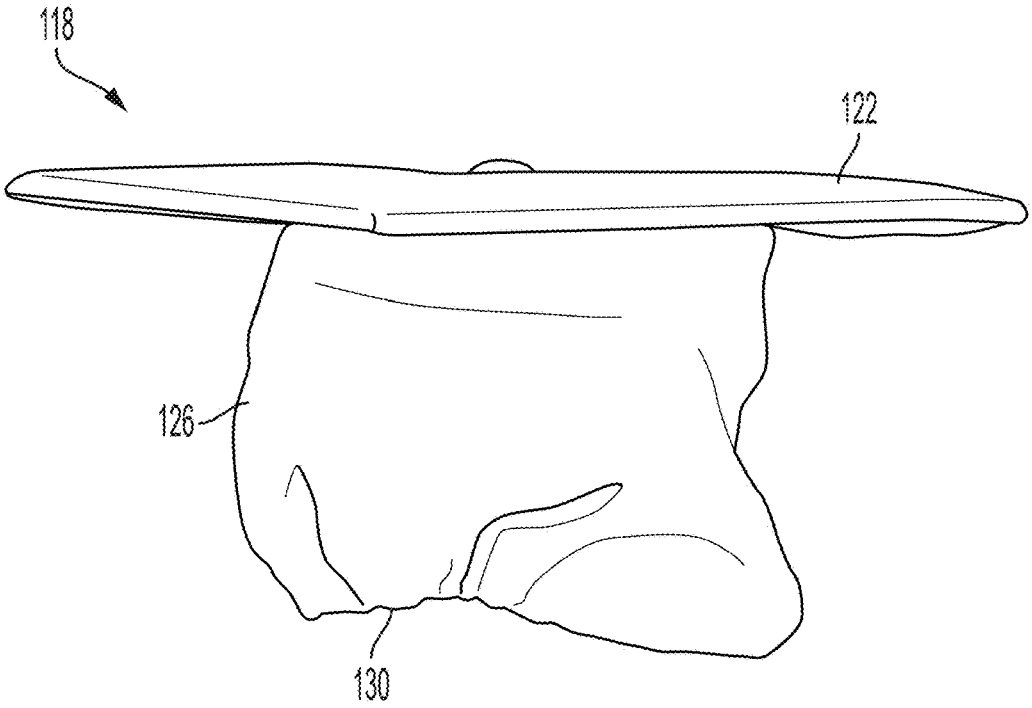
FIGS. 7A-7D depict perspective, front, top, and bottom views, respectively, of an academic cap with which some of the present headwear securing systems can be used.
Figure 7B:
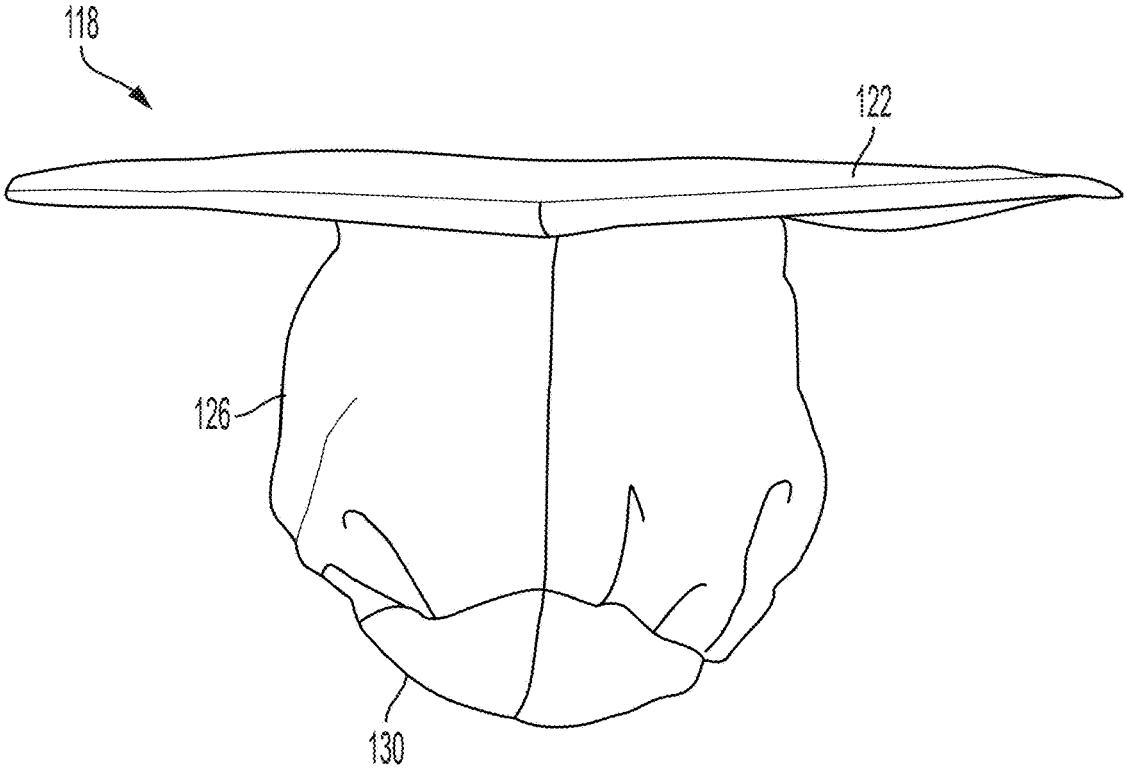
Figure 7C:
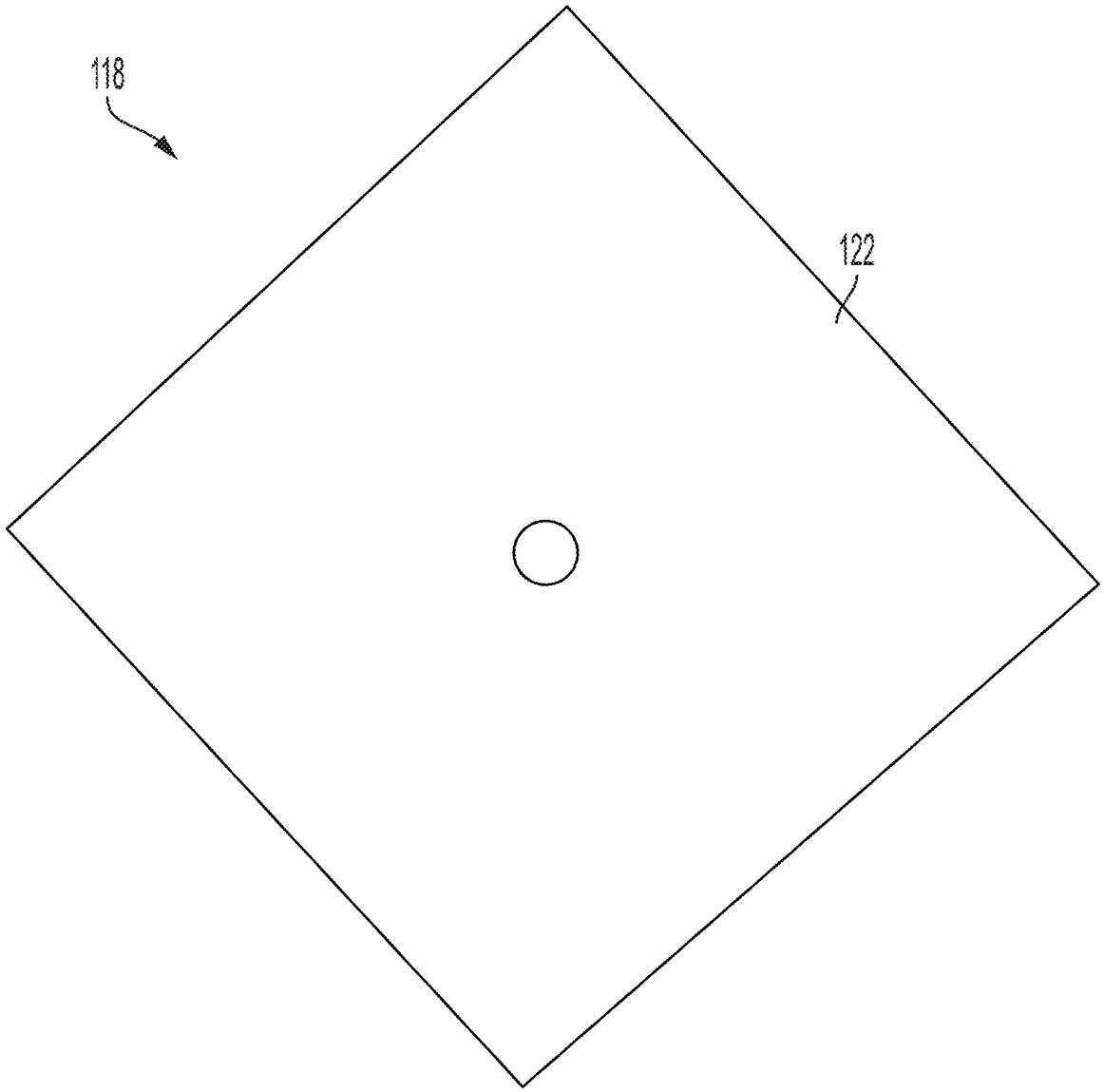
Figure 7D:
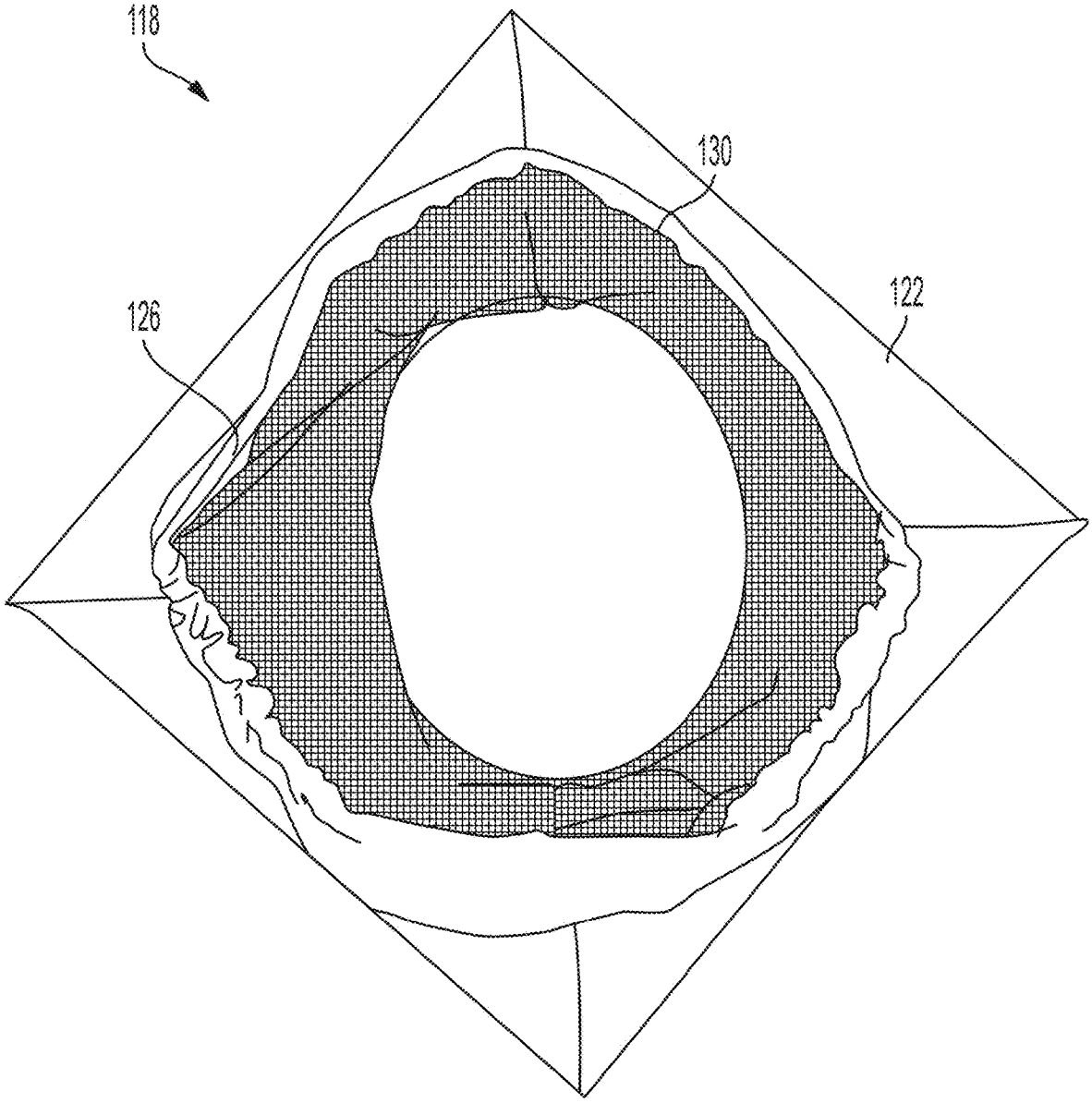

To facilitate the releasable engagement of tab(s) 82*a* and 82*b* with receptacle(s) 70*a* and 70*b*, each of the receptacle(s) can comprise a ledge 94 having an upper surface 98 that is substantially perpendicular to inner surface 58*a* of inner ring 18 and each of the tab(s) can comprise a protrusion 86 having upper and lower surfaces 90*a* and 90*b*, respectively. When each of tab(s) 82*a* and 82*b* is received in receiving space 74 defined by a respective one of receptacle(s) 70*a* and 70*b*, upper surface 90*a* of the protrusion can be angularly disposed relative to upper surface 98 of ledge 94 of the respective receptacle and lower surface 90*b* of the protrusion can be disposed on the upper surface of the ledge of the receptacle (FIG. 6G). This design can facilitate sufficient engagement between tab(s) 82*a* and 82*b* and receptacle(s) 70*a* and 70*b* in a simple manner for the wearer. By pressing each of tab(s) 82*a* and 82*b* into and through a respective one of receptacle(s) 70*a* and 70*b*, the angled upper surface 90*a* of protrusion 86 of the tab can facilitate elastic deflection of the tab around ledge 94 when the protrusion engages the ledge such that the protrusion can move upwardly past the ledge. For each tab 82*a* and 82*b*, once the protrusion 86 clears upper surface 98 of ledge 94, the tab can return to its original orientation, allowing lower surface 90*b* of the protrusion to engage the ledge's upper surface. Should the wearer need to disassemble headband 22 from inner ring 18, simply pressing each of tab(s) 82*a* and 82*b* laterally to elastically deflect the tab can clear the tab's protrusion 86 from upper surface 98 of ledge 94, thereby allowing the wearer to slide the tab out of the receptacle with which the tab was releasably engaged.

Tab(s) 82*a* and 82*b* and receptacle(s) 70*a* and 70*b* can be arranged in a manner that promotes headband 22's securement to inner ring 18 to mitigate the risk of the inner ring shifting relative to the headband. For example, when tab(s) 82*a* and 82*b* include first and second tabs and receptacle(s) 70*a* and 70*b* include first and second receptacles, each receptacle can be positioned opposite the other, e.g., such that when inner ring 18 is received in volume 26 circumscribed by outer ring 14, a transverse axis of the volume can extend through the first and second receptacles. This can mitigate, for example, rotation of inner ring 18 relative to headband 22. Preferably, when volume 26 has an elliptical cross-section, the transverse axis of the volume extending through first and second receptacles 70*a* and 70*b* is minor axis 46 of the elliptical cross-section such the tab-based securement of headband 22 to inner ring 18 can occur at opposing sides of the wearer's head on which the headband is disposed, which can promote a secure and comfortable fit.

When tab(s) 82*a* and 82*b* are each received in receiving space 74 defined by a respective one of receptacle(s) 70*a* and 70*b* on inner ring 18, a portion of headband 22 can be disposed in and first and second ends 30*a* and 30*b* of the headband can be disposed below volume 26 circumscribed by the outer ring. This can allow the portion of headband 22 disposed in volume 26 to be obscured from view by outer ring 14, the outer ring and inner ring 18 to sit close to the head of a wearer, and a portion of the headband to extend downwardly away from the outer and inner rings for engagement with the sides of a wearer's head.

Headwear securing system 10 can be used to secure a variety of pieces of headwear to a wearer's head, but—as noted above—can be especially well-suited for use with an academic cap. Referring now to FIGS. 7A-7D, shown is an academic cap 118 in which headwear securing system 10 can be secured. Academic cap 118 can comprise a board 122 that can have a square planform and a skullcap 126. Skullcap 126 can be coupled to and underlie the board, and can be configured to be placed on a head of a wearer. For example, skullcap 126 can comprise fabric (e.g., a polymeric and/or cotton fabric) and can comprise an edge 130 that is not fixed to board 122 such that the edge can surround a wearer's head. Skullcap 126 itself may be a poor fit for at least some wearers—especially those with a significant amount of hair—that can cause discomfort and yield a poor appearance. Headwear securing system 10 can be installed in academic cap 118 to such that the headwear securing system—rather than skullcap 126—can secure the academic cap to the head, which can improve the fit, comfort, and appearance of the academic cap on a variety of wearers.

Figure 8A:
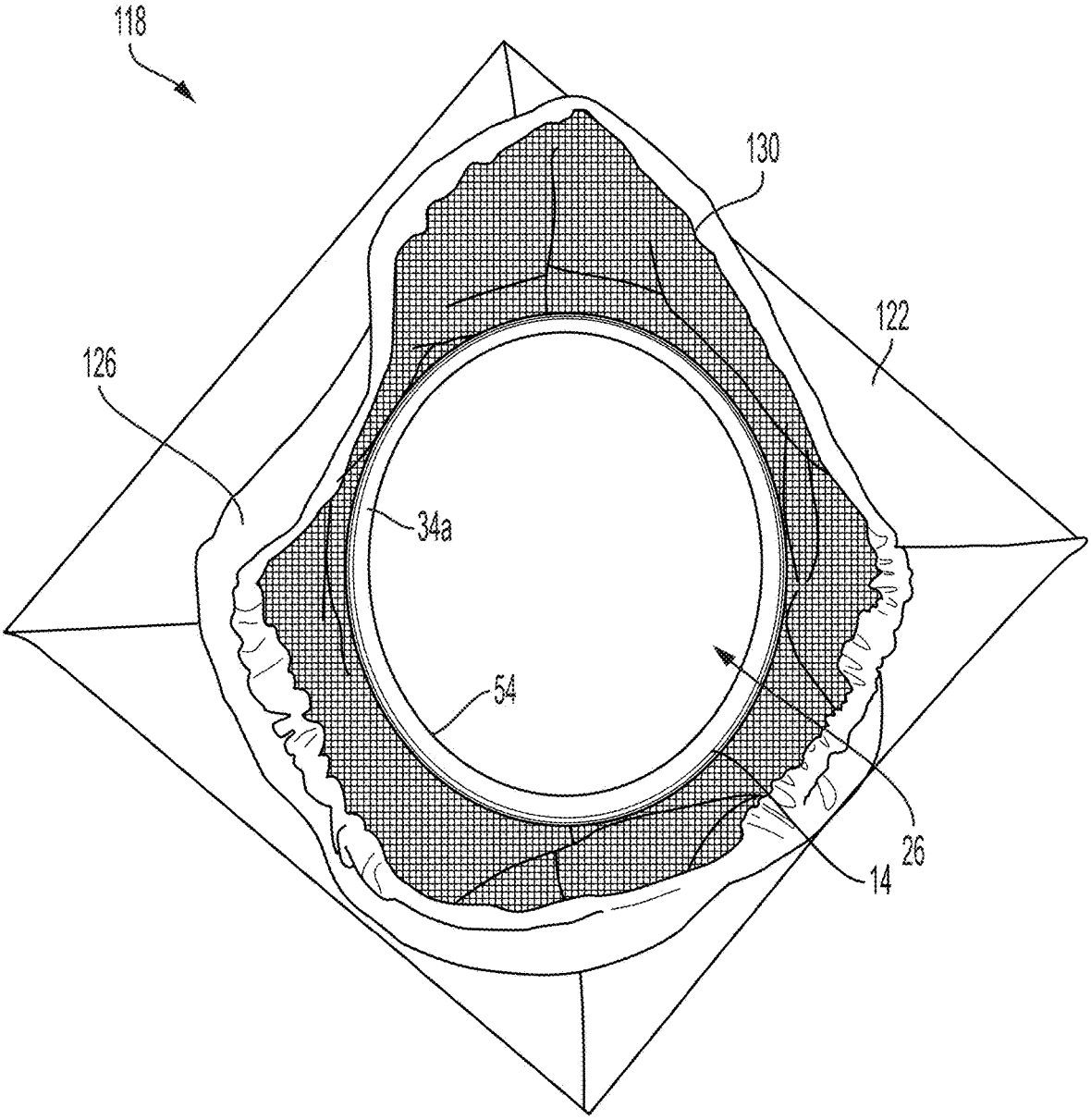
FIGS. 8A-8D depict installation of the headwear securing system of FIG. 1A into the academic cap of FIGS. 7A-7D, where the system's outer ring is placed in the skullcap of the academic cap (FIG. 8A), the skullcap is folded over the outer ring (FIG. 8B), the inner ring is placed in the volume circumscribed by the outer ring such that a portion of the skullcap material folder over the outer ring is secured between the outer and inner rings and the inner ring is secured in relation to the outer ring (FIG. 8C), and the headband is coupled to the inner ring of the system (FIG. 8D).
Figure 8B:
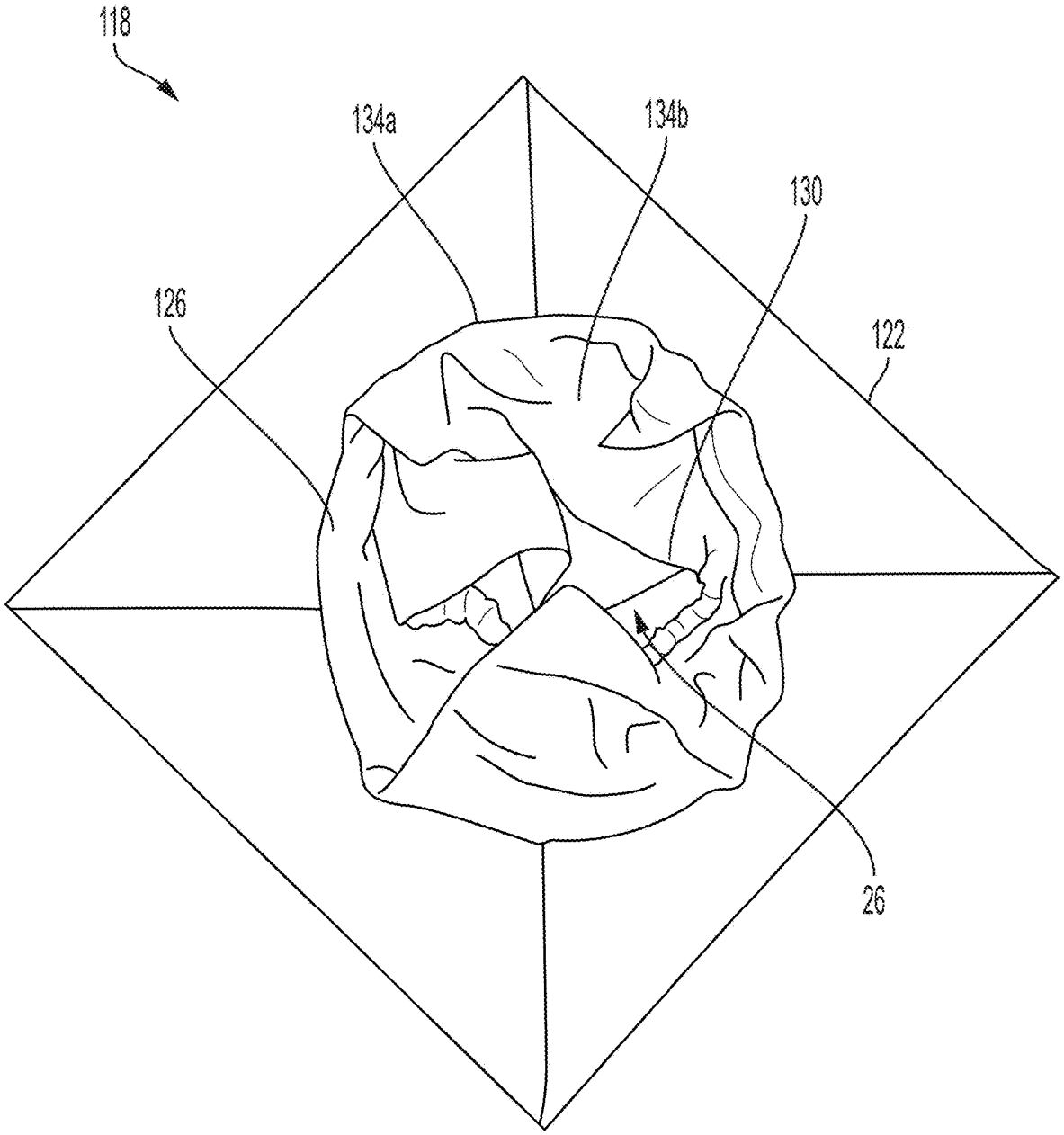
Figure 8C:
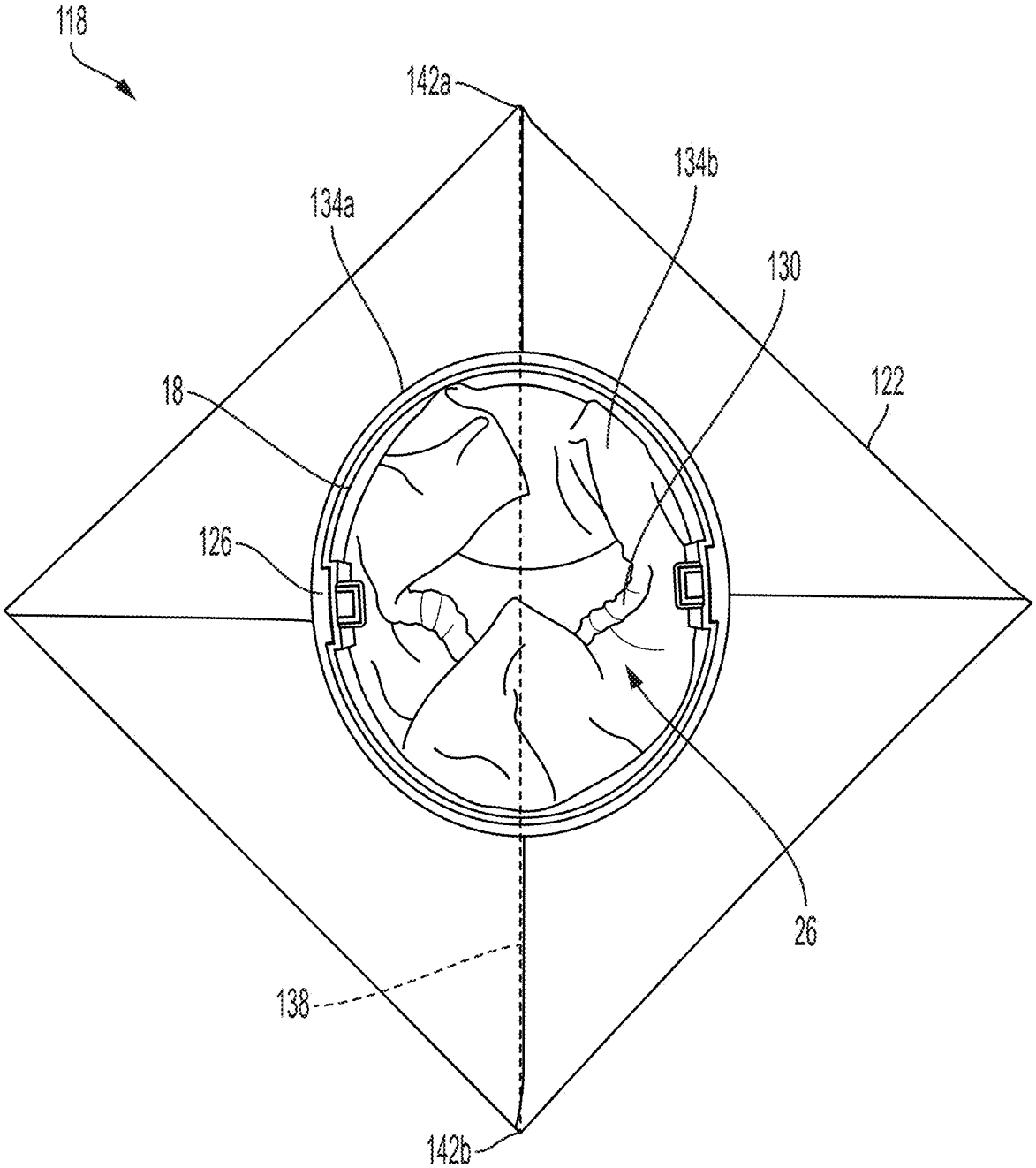

Referring now to FIGS. 8A-8D, shown are some of the present methods of installing a headwear securing system (e.g., 10) (e.g., any of those described above) in an academic cap (e.g., 118) (e.g., any of those described above). As shown in FIGS. 8A and 8B, some methods comprise placing an outer ring (e.g., 14) of the headwear securing system on a board (e.g., 122) of the academic cap (e.g., 118) (FIG. 8A) and folding a skullcap (e.g., 126) of the academic cap over the outer ring such that a first portion (e.g., 134*a*) of the skullcap is disposed along the outer surface (e.g., 34*b*) of the outer ring and a second portion (e.g., 134*b*) of the skullcap that includes an edge (e.g., 130) of the skullcap is disposed in the volume (e.g., 26) circumscribed by the outer ring (FIG. 8B). And, as shown in FIG. 8C, to secure the skullcap to the headwear securing system, some methods comprise disposing an inner ring (e.g., 18) of the headwear securing system in the volume circumscribed by the outer ring such that at least some of the second portion of the skullcap can be disposed between the inner surface (e.g., 34*a*) of the outer ring and the outer surface (e.g., 58*b*) of the inner ring. When the outer ring includes a lip (e.g., 54), the lip can be disposed between the inner ring and the board of the academic cap. As explained above, with the outer and inner rings having similar sizes such that a distance between them is relatively small and at least some of the second portion of the skullcap is disposed between the outer and inner rings, friction can hold the components into place. With the inner ring disposed in the volume, both rings can be secured in relation to each other, and the academic cap can be secured in relation to the rings due at least in part to the skullcap being sandwiched between the two rings. And the first portion of the skullcap can be taut along the outer surface of the outer ring while the edge of the skullcap can remain in the volume circumscribed by the outer ring (e.g., such that the outer ring obscures a view thereof), which can promote a neat appearance.

Figure 8D:
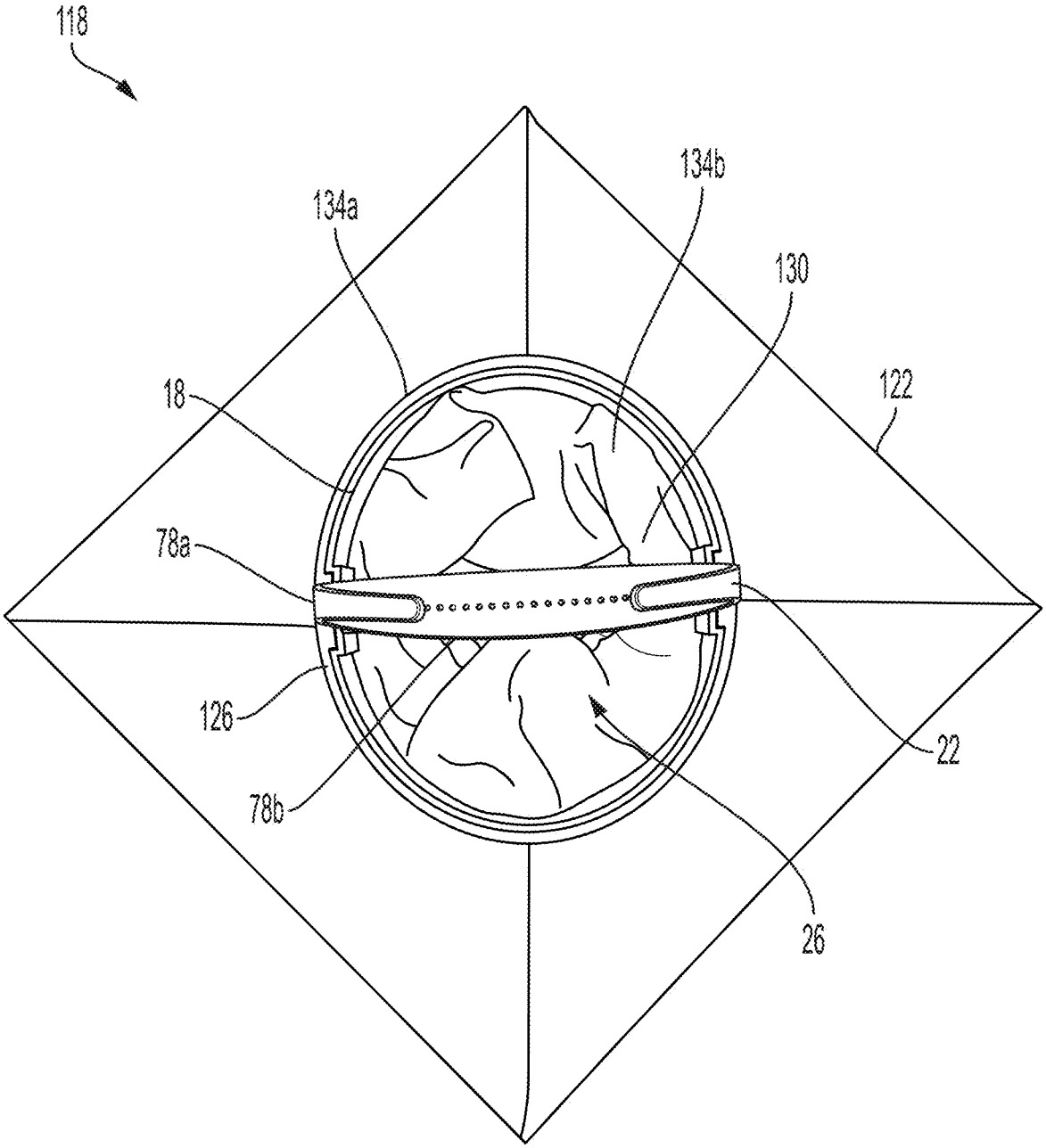

As shown in FIG. 8D, some methods comprise coupling a headband (e.g., 22) of the headwear securing system to the inner ring (e.g., after installation of the outer and inner rings). As explained previously, coupling the headband to the inner ring can comprise disposing each of one or more (e.g., first and second) tabs (e.g., 82*a* and 82*b*) that are coupled to and extend away from the upper surface (e.g., 78*a*) of the headband into a receiving space (e.g., 74) defined by a respective one of one or more (e.g., first and second) receptacles (e.g., 70*a* and 70*b*) of the inner ring such that the tab releasably engages the receptacle, which can allow the tab(s) (and thus the headband) to be secured to the inner ring. As noted previously, a portion of the headband can be disposed in and the first and second ends (e.g., 30*a* and 30*b*) of the headband can be disposed below the volume circumscribed by the outer ring when the headband is coupled to the inner ring and the inner ring is disposed in the volume.

The outer ring can be positioned such that a major axis (e.g., 42) of an elliptical cross-section of the volume circumscribed by the outer ring can be substantially parallel to a line (e.g., 138) that extends between first and second vertices (e.g., 142*a* and 142*b*) of the board through a center of the board (FIG. 8C). This can permit the headwear securing system to have an orientation that allows it to appropriately position the academic cap when the headwear securing system is worn and can promote a neat, well-proportioned appearance.

Headwear securing system 10 installed in academic cap 118 is depicted in—in addition to FIG. 8D—FIGS. 9A and 9B. As shown, headwear securing system 10's outer ring 14—which can underlie board 122—can improve the aesthetics of skullcap 126, and headband 122 can be placed on a head of a wearer to securely adorn the academic cap.

The above specification and examples provide a complete description of the structure and use of illustrative embodiments. Although certain embodiments have been described above with a certain degree of particularity, or with reference to one or more individual embodiments, those of ordinary skill in the art could make numerous alterations to the disclosed embodiments without departing from the scope of this invention. As such, the various illustrative embodiments of the apparatuses and methods are not intended to be limited to the particular forms disclosed. Rather, they include all modifications and alternatives falling within the scope of the claims, and embodiments other than the ones shown may include some or all of the features of the depicted embodiments. For example, elements may be omitted or combined as a unitary structure, and/or connections may be substituted. Further, where appropriate, aspects of any of the examples described above may be combined with aspects of any of the other examples described to form further examples having comparable or different properties and/or functions and addressing the same or different problems. Similarly, it will be understood that the benefits and advantages described above may relate to one embodiment or may relate to several embodiments.

The claims are not intended to include, and should not be interpreted to include, means plus- or step-plus-function limitations, unless such a limitation is explicitly recited in a given claim using the phrase(s) "means for" or "step for," respectively.

The invention claimed is:

1. A headwear securing system comprising:

an outer ring having opposing inner and outer surfaces and a first circumference;

an inner ring having a second circumference less than the first circumference of the outer ring such that the inner ring is configured to be received entirely within a volume circumscribed by the outer ring, the inner ring having:

opposing inner and outer surfaces; and one or more receptacles, each coupled to the inner surface of the inner ring and defining a receiving space;

a headband that has:

first and second ends;

opposing upper and lower surfaces; and front and rear edges that each connect the upper surface to the lower surface and extend between the first and second ends;

wherein the headband is curved such that the front and rear edges of the headband each subtend an angle that is greater than or equal to 180° between the first and second ends; and one or more tabs, wherein each of the one or more tabs:

is coupled to and extends away from the upper surface of the headband; and is configured to be received in the receiving space defined by a respective one of the one or more receptacles such that the one or more tabs releasably engages the one or more receptacles;

wherein the inner ring is configured to be received entirely within the volume circumscribed by the outer ring such that:

the outer surface of the inner ring faces the inner surface of the outer ring and the inner ring is obscured from view by the outer ring; and when the one or more tabs are each received in the receiving space defined by a respective one of the one or more receptacles: (i) an upper portion of the headband is disposed in the volume circumscribed by the outer ring; and (ii) the first and second ends of the headband are disposed entirely below the volume circumscribed by the outer ring and extending downwardly away from the outer and inner rings for engagement with respective sides of a wearer's head.

2. The headwear securing system of claim 1, wherein:

the one or more receptacles comprise first and second receptacles;

the one or more tabs comprise first and second tabs, each configured to be received in the receiving space defined by a respective one of the first and second receptacles; and when the inner ring is received in the volume circumscribed by the outer ring, a transverse axis of the volume extends through the first and second receptacles.

3. The headwear securing system of claim 1, wherein the volume circumscribed by the outer ring has an elliptical cross-section.

4. The headwear securing system of claim 3, wherein:

the one or more receptacles comprise first and second receptacles;

the one or more tabs comprise first and second tabs, each configured to be received in the receiving space defined by a respective one of the first and second receptacles; and when the inner ring is received in the volume circumscribed by the outer ring, a minor axis of the elliptical cross-section of the volume extends through the first and second receptacles.

5. The headwear securing system of claim 3, wherein:
a major axis of the elliptical cross-section of the volume circumscribed by the outer ring is between 13.5 and 14.5 centimeters; and
a minor axis of the elliptical cross-section of the volume circumscribed by the outer ring is between 11.5 and 12.5 centimeters.

6. The headwear securing system of claim 1, wherein a maximum transverse dimension of the inner ring is within 5% of a maximum transverse dimension of the volume circumscribed by the outer ring.

7. The headwear securing system of claim 1, wherein when the inner ring is received in the volume circumscribed by the outer ring, along at least a majority of the outer surface of the inner ring a distance between the outer surface of the inner ring and the inner surface of the outer ring is less than or equal to 3 millimeters.

8. The headwear securing system of claim 1, wherein:
the outer ring comprises a lip coupled to and extending away from the inner surface of the outer ring; and
the inner ring is configured to abut the lip of the outer ring when the inner ring is received in the volume circumscribed by the outer ring.

9. The headwear securing system of claim 1, wherein:
each of the one or more receptacles comprises a ledge having an upper surface that is perpendicular to the inner surface of the inner ring; and
each of the one or more tabs comprises a protrusion having upper and lower surfaces, wherein when the one or more tabs is received in the receiving space defined by a respective one of the one or more receptacles:
the upper surface of the protrusion is angularly disposed relative to the upper surface of the ledge of the one or more receptacles; and
the lower surface of the protrusion is disposed on the upper surface of the ledge of the one or more receptacles.

10. The headwear securing system of claim 1, wherein the headband comprises ten or more protuberances, wherein each of the ten or more protuberances:
is coupled to and extends away from the lower surface of the headband; and
has a length that is less than or equal to 5 millimeters.

11. An academic cap comprising:
a board;
a skullcap that is coupled to and underlies the board, comprises fabric, and has an edge that is not fixed to the board; and
a headwear securing system comprising:
an outer ring having opposing inner and outer surfaces and a first circumference;
an inner ring having a second circumference less than the first circumference of the outer ring such that the inner ring is configured to be received entirely within a volume circumscribed by the outer ring such that the inner ring can be obscured from view by the outer ring, the inner ring having:
opposing inner and outer surfaces; and
one or more receptacles, each coupled to the inner surface of the inner ring and defining a receiving space;
a headband that has:
first and second ends;
opposing upper and lower surfaces; and
front and rear edges that each connect the upper surface to the lower surface and extend between the first and second ends;
wherein the headband is curved such that the front and rear edges of the headband each subtend an angle that is greater than or equal to 180° between the first and second ends; and
one or more tabs, wherein each of the one or more tabs is coupled to and extends away from the upper surface of the headband;
wherein the outer ring underlies the board, the skullcap is folded over the outer ring, and the inner ring is received entirely within the volume circumscribed by the outer ring such that:
a first portion of the skullcap is disposed along the outer surface of the outer ring;
a second portion of the skullcap that includes the edge of the skullcap is disposed in the volume circumscribed by the outer ring; and
at least some of the second portion of the skullcap is disposed between the inner surface of the outer ring and the outer surface of the inner ring;
wherein each of the one or more tabs is received in the receiving space defined by a respective one of the one or more receptacles such that the one or more tabs is releasably engaged with the one or more receptacles; and
wherein an upper portion of the headband is disposed in the volume circumscribed by the outer ring and the first and second ends of the headband are disposed entirely below the volume circumscribed by the outer ring and extending downwardly away from the outer and inner rings for engagement with respective sides of a wearer's head.

12. The academic cap of claim 11, wherein the volume circumscribed by the outer ring has an elliptical cross-section.

13. The academic cap of claim 12, wherein:
the one or more receptacles comprise first and second receptacles;
the one or more tabs comprise first and second tabs, each received in the receiving space defined by a respective one of the first and second receptacles; and
a minor axis of the elliptical cross-section of the volume extends between the first and second receptacles.

14. The academic cap of claim 12, wherein:
a planform of the board is square; and
a major axis of the elliptical cross-section of the volume circumscribed by the outer ring is parallel to a line that extends between first and second vertices of the board through a center of the board.

15. The academic cap of claim 12, wherein:
a major axis of the elliptical cross-section of the volume circumscribed by the outer ring is between 13.5 and 14.5 centimeters; and
a minor axis of the elliptical cross-section of the volume circumscribed by the outer ring is between 11.5 and 12.5 centimeters.

16. The academic cap of claim 12, wherein a maximum transverse dimension of the inner ring is within 5% of a maximum transverse dimension of the volume circumscribed by the outer ring.

17. The academic cap of claim 11, wherein along at least a majority of the outer surface of the inner ring a distance between the outer surface of the inner ring and the inner surface of the outer ring is less than or equal to 3 millimeters.

18. The academic cap of claim 11, wherein:
the outer ring comprises a lip coupled to and extending away from the inner surface of the outer ring; and
the lip is disposed between the inner ring and the board.

19. The academic cap of claim 11, wherein:

each of the one or more receptacles comprises a ledge having an upper surface that is perpendicular to the inner surface of the inner ring; and each of the one or more tabs comprises a protrusion having upper and lower surfaces, wherein for the one or more receptables defining the receiving space in which the one or more tabs is received:

the upper surface of the protrusion is angularly disposed relative to the upper surface of the ledge of the one or more receptacles; and the lower surface of the protrusion is disposed on the upper surface of the ledge of the one or more receptacles.

20. The academic cap of claim 11, wherein the headband comprises ten or more protuberances, wherein each of the ten or more protuberances:

is coupled to and extends away from the lower surface of the headband; and has a length that is less than or equal to 5 millimeters.

* * * * *